US008302532B2

(12) United States Patent
Izume

(10) Patent No.: US 8,302,532 B2
(45) **Date of Patent: *Nov. 6, 2012**

(54) PRINTING MACHINE

(75) Inventor: Masayuki Izume, Kyoto (JP)

(73) Assignee: I. Mar Planning Inc., Kyoto (JP)

( * ) Notice: Subject to any disclaimer, the term of this patent is extended or adjusted under 35 U.S.C. 154(b) by 767 days.

This patent is subject to a terminal disclaimer.

(21) Appl. No.: 11/887,367

(22) PCT Filed: Mar. 29, 2006

(86) PCT No.: PCT/JP2006/306426

§ 371 (c)(1),
(2), (4) Date: Sep. 11, 2009

(87) PCT Pub. No.: WO2006/104187

PCT Pub. Date: Oct. 5, 2006

(65) Prior Publication Data

US 2009/0320704 A1 Dec. 31, 2009

(30) Foreign Application Priority Data

Mar. 29, 2005 (JP) ..... 2005-095299

(51) Int. Cl.
*B41F 31/06* (2006.01)
*B41F 31/02* (2006.01)

(52) U.S. Cl. ..... 101/364; 101/350.1

(58) Field of Classification Search ..... 101/364, 101/366, 350.1, 479, 480
See application file for complete search history.

(56) References Cited

U.S. PATENT DOCUMENTS 3,199,451 A * 8/1965 Nitchie ..... 101/366
(Continued)

FOREIGN PATENT DOCUMENTS

DE 199 08 841 10/1999
(Continued)

OTHER PUBLICATIONS

Supplementary European Search Report for European Patent Application No. 06730374.3 dated Dec. 27, 2010.

*Primary Examiner* — Judy Nguyen
*Assistant Examiner* — Leo T Hinze
(74) *Attorney, Agent, or Firm* — Edwards Wildman Palmer LLP; James E. Armstrong, IV; Brian R. Landry

(57) ABSTRACT

A printing machine in which substantial automation of the replacement procedure is achieved, and thus significant simplification of replacement procedure, and reduction of time required for the procedure are achieved is provided. The printing machine comprises an ink fountain member 2, an ink fountain roller 3, a strip of sheet 39 of which middle part is placed over the ink fountain member 2, a sheet moving device 40, a pair of barrier plates 53 attracted to the ink fountain member 2 under the sheet 39 and attracted to the outer peripheral surface of the ink fountain roller 3 by a permanent magnet, a cleaning tank 56, a cleaning blade 57, a reciprocating device 58, a barrier plate replacing device 85, a plurality of ink containers 65 accommodating different types of ink and being stored in a container storage unit 66, and an ink supply device 86 for holding the desired ink container 65 and supplying the ink therein to the ink fountain 1.

15 Claims, 10 Drawing Sheets

U.S. PATENT DOCUMENTS

| | | | | |
|---|---|---|---|---|
| 5,492,058 | A * | 2/1996 | Greive | 101/148 |
| 5,688,217 | A * | 11/1997 | Izume | 492/39 |
| 5,823,110 | A * | 10/1998 | Izume | 101/352.09 |
| 5,839,368 | A * | 11/1998 | Ohinata | 101/364 |
| 5,974,970 | A | 11/1999 | Izume | |
| 6,269,744 | B1 | 8/2001 | Blaser et al. | |
| 6,349,645 | B1 | 2/2002 | Roskosch | |
| 6,619,206 | B2 * | 9/2003 | Koehler | 101/364 |
| 6,862,988 | B2 * | 3/2005 | Dylla et al. | 101/351.3 |
| 2002/0096072 | A1 | 7/2002 | Fujimoto et al. | |
| 2009/0205522 | A1 * | 8/2009 | Izume | 101/367 |

FOREIGN PATENT DOCUMENTS

| | | | |
|---|---|---|---|
| DE | 199 28 880 | | 1/2000 |
| EP | 1 262 322 | A1 | 12/2002 |
| JP | 52-144002 | | 11/1977 |
| JP | 5-26375 | | 4/1993 |
| JP | 5-44845 | | 6/1993 |
| JP | 07-052365 | | 2/1995 |
| JP | 3194174 | | 3/1995 |
| JP | 09-183214 | | 7/1997 |
| JP | 09-193356 | | 7/1997 |
| JP | 10278232 | | 10/1998 |
| JP | 11-077975 | | 3/1999 |
| JP | 11-320837 | | 11/1999 |
| JP | 2000-141610 | | 5/2000 |
| JP | 2001-341276 | | 12/2001 |

* cited by examiner

PRINTING MACHINE

CROSS REFERENCE TO RELATED APPLICATIONS

This application is related to three co-pending applications: "UNIT OF A PLURALITY OF DIVIDED VIBRATING ROLLERS AND PRINTING MACHINE" filed even date herewith in the names of Masayuki Izume as a national phase entry of PCT/JP2006/306428; "PRINTING MACHINE" filed even date herewith in the name of Masayuki Izume as a national phase entry of PCT/JP2006/306430; and "PRINTING MACHINE" filed even date herewith in the name of Masayuki Izume as a national phase entry of PCT/JP2006/306434; which applications are assigned to the assignee of the present application and all three incorporated by reference herein.

TECHNICAL FIELD

The present invention relates to a printing machine.

BACKGROUND ART

In the usual printing machine, an ink fountain roller is arranged close to an ink fountain member forming an ink fountain, ink applied to the outer peripheral surface of the ink fountain roller from the ink fountain is transferred to an ink distributing roller by a vibrating roller, and the ink is further supplied to the printing surface of the printing portion via a plurality of other ink distributing rollers.

Conventionally, the ink fountain member has a plate shape, and the ink in the ink fountain is applied to the outer peripheral surface of the ink fountain roller through an ink channel defined by the ink fountain member and the ink fountain roller.

In such printing machine, the type of ink to use sometimes needs to be changed depending on the content of printing, in which case, the replacement procedure of changing the ink in the ink fountain for that to be used for the next printing is performed after the previous printing is completed. The replacement procedure includes collecting old ink in the ink fountain as well as cleaning the ink fountain member and each roller.

In the conventional printing machine, the vibrating roller and the ink distributing roller are automatically cleaned by a so-called inker cleaning, but the ink fountain roller and the ink fountain member are cleaned manually in the following manner since automation of cleaning is difficult to perform thereon. After the previous printing is completed, the old ink remaining in the ink fountain is taken out manually with the rotation of the ink fountain roller stopped, and the portion of the ink fountain roller and the ink fountain member that have contacted the ink is cleaned by hand. Thus, the collecting old ink and the cleaning works are troublesome, and furthermore, the replacement procedure requires time since the ink fountain member and the ink fountain roller must be cleaned by hand, whereby a long time is required until the next printing can be started.

Furthermore, the size (width) of the ink channel sometimes needs to be changed depending on the content of printing, in which case, the size of the ink channel is adjusted by changing the position or the angle of the ink fountain member in the prior art, but such adjustment is also troublesome.

The inventor of the present invention thus proposed the printing machine disclosed in patent document 1.

The printing machine includes an ink fountain member having fountain-forming faces; an ink fountain roller for applying the ink to its outer peripheral surface through the ink channel between the ink fountain roller and the ink fountain member; a plurality of rollers for supplying the ink applied to the outer peripheral surface of the ink fountain roller to the printing portion; a strip of sheet placed over the ink fountain member so as to cover the fountain-forming face with the middle part closely attached thereto; a sheet moving device for moving the strip of sheet in the length direction thereof; a pair of barrier plates attracted to the fountain-forming face from above the sheet and attracted to the outer peripheral surface of the ink fountain roller by a permanent magnet to form side plates of the ink fountain; a cleaning tank arranged close to and blow the ink fountain roller; a cleaning blade arranged in the cleaning tank; and a reciprocating device for switching the cleaning blade between a cleaning position of being in pressing contact with the outer peripheral surface of the ink fountain roller and a stand-by position of being away from the ink fountain roller. The ink fountain member is turned by a turning device to be positioned at one of a plurality of work positions, where a plurality of fountain-forming faces on which an ink channel-defining portion at the distal end comes close to the ink fountain roller and forms the ink fountain when positioned at each work position are formed at the periphery of the ink fountain member in the turning direction of the ink fountain member, and the distance from the central axis of rotation of the ink fountain member to each ink channel-defining portion differs from each other.

Patent document 1: Japanese Patent Publication No. 3194174

DISCLOSURE OF THE INVENTION

Problems to be Solved by the Invention

The replacement procedure can be simplified compared to the prior art and the working time can be reduced in the above described printing machine.

However, the replacement of the old barrier plate by the new barrier-plate, supply of new ink to the ink fountain and the like cannot be automatically performed, and thus simplification of the replacement procedure and reduction in the working time are not adequate.

Since the barrier plate is strongly attracted to the fountain-forming face and the outer peripheral surface of the ink fountain roller by the permanent magnet, automatic replacement thereof is difficult. In the case where the barrier plate is attracted to the fountain-forming face and the outer peripheral surface of the ink fountain roller with use of electromagnet, the barrier plate can be easily and automatically replaced by stopping the current flow to the electromagnet. However, in such case, the current must be constantly flowed to the electromagnet during printing, where heat generation of the electromagnet and adverse effects thereof are significant, and thus there is no other choice but to use the permanent magnet.

Furthermore, it is difficult to automatically supply the ink in a metal can and the like into the ink fountain.

Moreover, when printing in large amounts, the ink in the ink fountain may degrade during printing and adversely effect the printing quality since the desired ink is placed in great amount all at once in the ink fountain. Furthermore, the old ink sometimes remains in great amounts in replacement, in which case, the remaining ink becomes a waste, and furthermore, a great amount of time is required to collect the remaining ink.

In view of solving the above problems, an object of the present invention is to provide a printing machine in which substantial automation of the replacement procedure is achieved, and thus significant simplification of replacement procedure, and reduction of time required for the procedure are achieved.

Means for Solving the Problems

The printing machine of claim 1 comprises an ink fountain member having a fountain-forming face; an ink fountain roller for applying an ink to an outer peripheral surface through an ink channel between the ink fountain roller and the ink fountain member; a plurality of rollers for supplying the ink applied to the outer peripheral surface of the ink fountain roller to a printing portion; a strip of sheet placed over the ink fountain member so as to cover the fountain-forming face with the middle portion of the strip of sheet being in intimate contact with the fountain-forming face; a sheet moving device for moving the strip of sheet in the length direction; a pair of barrier plates attracted to the fountain-forming face from above the sheet and attracted to the outer peripheral surface of the ink fountain roller by a permanent magnet to form side walls of the ink fountain; a cleaning tank disposed close to the lower part of the ink fountain roller; a cleaning blade arranged in the cleaning tank; a reciprocating device for switching the cleaning blade between a cleaning position of being in pressing contact with the outer peripheral surface of the ink fountain roller and a stand-by position of being away from the ink fountain roller; a barrier plate replacing device for detaching the used barrier plate from the ink fountain member and the ink fountain roller and attaching the new barrier plate to the ink fountain member and the ink fountain roller; a plurality of ink containers, accommodating different types of ink, and being stored in a predetermined container storage unit; and an ink supply device for holding the desired ink container and supplying the ink to the ink fountain.

In the specification, the term "sheet" is used to encompass all flexible members of thin plate shape having an extremely small thickness compared to the length and the width. There is no restriction on the thickness of the sheet, and thus also encompasses sheets having a relatively large thickness and films having a small thickness.

When performing printing, the ink fountain member is positioned and stopped at a predetermined work position. The pair of barrier plates are attracted to the fountain-forming face under the sheet and are attracted to the outer peripheral surface of the ink fountain roller, where the portion of the sheet covering the fountain-forming face of the ink fountain member is in intimate contact with the fountain-forming face and does not move in either direction. The ink fountain is formed by the fountain-forming face covered by the sheet, the outer peripheral surface of the ink fountain roller, and the barrier plates, and the ink is supplied from the desired container to the ink fountain by the ink supply device. The ink channel is formed between the distal end of the fountain-forming face covered with the sheet and the outer peripheral surface of the ink fountain roller. The cleaning blade is switched to the stand-by position and is away from the ink fountain roller. When the ink fountain roller is rotated in such a state, the ink in the ink fountain is applied to the outer peripheral surface of the ink fountain roller through the ink channel. The ink applied to the outer peripheral surface of the ink fountain roller is supplied to the printing surface, in the similar manner as in the prior art.

In time of replacement procedure, the cleaning blade is switched to the cleaning position and is in pressing contact with the ink fountain roller, and the ink fountain roller is rotated in such a state. The old ink remaining in the ink fountain is applied to the outer peripheral surface of the ink fountain roller through the ink channel by the rotation of the ink fountain roller, in the similar manner as the time of printing, but such ink is scraped of f by the cleaning blade, and collected in the cleaning tank. After all the ink remaining in the ink fountain is taken out by the ink fountain roller and collected in the cleaning tank by the cleaning blade, the ink fountain roller keeps rotating for a while in such a state, so that the ink remaining on the outer peripheral surface of the ink fountain roller is mostly scraped off by the cleaning blade. Thereafter, the outer peripheral surface of the ink fountain roller is cleaned, as necessary. After the old ink remaining in the ink fountain is collected, the barrier plates attached with the old ink are detached from the fountain-forming face and the outer peripheral surface of the ink fountain roller by the barrier plate replacing device, and the portion of the used sheet in intimate contact with the fountain-forming face up to this point and attached with the old ink is moved to the position detached from the fountain-forming face and the portion of the new sheet before use is brought in intimate contact with the fountain-forming face by the sheet moving device. Subsequently, the new barrier plates are attracted to the fountain-forming face under the sheet before use and are attracted to the outer peripheral surface of the ink fountain roller by the barrier plate replacing device. The ink fountain formed thereby is supplied with ink from a different ink container by the ink supply device, and the next printing is performed in the similar manner as the above.

Since the fountain-forming face of the ink fountain member is covered by the sheet, the ink will not attach thereto, and it is only necessary to move sheet so that the portion of the used sheet is detached from the fountain-forming face, and the portion of the sheet before use is in intimate contact with the fountain-forming face after the old ink remaining in the ink fountain is collected even in time of replacement procedure, whereby the ink fountain member does not need to be cleaned.

Furthermore, in time of replacement procedure, the old ink remaining in the ink fountain is automatically collected in the cleaning tank by the cleaning blade positioned at the cleaning position, as described above, and most of the ink on the outer peripheral surface of the ink fountain roller is scraped off, whereby only the outer peripheral surface of the ink fountain roller needs to be cleaned, as necessary, and the collecting work of the ink and the cleaning work are extremely simplified.

Moreover, in time of replacement procedure, since the replacement of the old barrier plates and the new barrier plates is automatically performed by the barrier plate replacing device, and the supply of ink from the ink container of different types to the ink fountain is automatically performed by the ink supply device, the replacement procedure is considerably automated, whereby significant simplification of the replacement procedure and reduction in time required for the replacement procedure are achieved.

For example, the sheet moving device comprises a feed shaft for feeding the portion of the sheet before use, a take-up shaft for taking up the portion of the used sheet, and a shaft driver for driving at least one of the shafts, where a core tube of the sheet roll winded with the sheet before use is removably fixed to the feed shaft, and a sheet take-up member for taking up the used sheet is removably fixed to the take-up shaft.

Accordingly, the sheet take-up member is removed from the take-up shaft after taking up all the sheet on the sheet take-up member when the sheet winded on the sheet roll is used up, and the sheet take-up member is again fixed to the take-up shaft after taking out the used sheet from the sheet take-up member, and the core tube of the used sheet roll is removed from the feed shaft and the core tube of the new sheet roll winded with sheet before use is fixed to the feed shaft.

For example, the shaft driver comprises an electric motor, and a power transmission mechanism for transmitting the rotation of the electric motor to the feed shaft and the take-up shaft, where the feed shaft rotates at a constant speed smaller than the take-up shaft, and a sliding mechanism that applies friction resistance and allows sliding is arranged at the power transmission mechanism for transmitting the rotation of the electric motor to the take-up shaft.

In a state the new sheet roll is fixed to the feed shaft and the distal end thereof is taken up to the sheet take-up member, the outer diameter of the sheet taken up to the sheet take-up member is smaller than the outer diameter of the sheet roll fixed to the feed shaft, but the relationship of the rotation speed of the feed shaft and the take-up shaft is defined so that the movement speed of the sheet at the portion of the sheet take-up member is greater than the movement speed of the sheet at the portion of the sheet roll fixed to the feed shaft assuming that the sliding mechanism does not allow sliding even in the above state.

Accordingly, wrinkles are not produced on the sheet since the sheet is moved while constantly being applied with tensile force.

The cleaning blade may be fixed to the cleaning tank, and the reciprocating device may switch the position of the blade by moving the tank. The blade may be movably attached to the tank, and the reciprocating device may switch the position of the blade by moving the blade with respect to the tank.

A printing machine of claim 2, which is according to claim 1, is characterized in that a barrier plate attracting portion of a predetermined width having the entire periphery made of magnetic material is arranged at at least two areas in the axial direction on the outer periphery of the ink fountain roller, and the portion other than the barrier plate attracting portion is made of non-magnetic material.

The fountain-forming face may be entirely made of magnetic material, or only the portion corresponding to the barrier plate attracting portion of the ink fountain roller may be made of magnetic material and the remaining portion may be made of non-magnetic material.

The barrier plate is attracted to the outer peripheral surface of the ink fountain roller by the permanent magnet, but the ink fountain roller rotates while slidably contacting the barrier plate. Thus, when the entire outer peripheral surface of the ink fountain roller and the entire fountain-forming face are made of magnetic material, for example, the barrier plate gradually moves in the axial direction of the ink fountain roller with the rotation of the ink fountain roller, whereby the position of the barrier plate may deviate.

In the case of the printing machine of claim 2, only the barrier plate attracting portion of the outer peripheral surface of the ink fountain roller is made of magnetic material, and other portions are made of non-magnetic material, and thus the barrier plate does not deviate from the barrier plate attracting portion and the change in position is small.

The width of the barrier plate attracting portion (length in the axial direction of the ink fountain roller) is preferably substantially the same as the width of the barrier plate.

Accordingly, the deviation of the barrier plate becomes extremely small or more or less eliminated.

For example, three or more barrier plate attracting portions may be arranged in the length direction of the ink fountain roller.

Accordingly, the width of the ink fountain can be adjusted by changing the barrier plate attracting portion for attracting the barrier plate according to the width of the printing surface.

A printing machine of claim 3, which is according to claim 1 or 2, is characterized in that the barrier plate replacing device includes, a fountain-member turning device for turning the ink fountain member around an axis parallel to the ink fountain roller, and positioning at a predetermined work position, a barrier plate stopper, arranged close to the outer peripheral surface of the ink fountain roller, for stopping the barrier plate rotated with the ink fountain roller away from the fountain-forming face by the turning of the ink fountain member from the work position, and turning the barrier plate in a direction away from the outer peripheral surface of the ink fountain roller, a moving body capable of moving above the ink fountain and being raised and lowered, and a barrier plate holding member disposed in the moving body to hold and release the barrier plate.

When the ink fountain member is turned with the barrier plate attached to the fountain-forming face and the outer peripheral surface of the ink fountain roller, the ink fountain member pushes the barrier plate so that the barrier plate detaches from the fountain-forming face, but the barrier plate rotates with the ink fountain roller while being attached to the outer peripheral surface of the ink fountain roller, and does not detach from the outer peripheral surface of the ink fountain roller if the barrier plate stopper is not arranged.

In the case of the printing machine of claim 3, since the barrier plate stopper is arranged, the barrier plate contacts and is stopped by the barrier plate stopper when pushed by the ink fountain member and rotated to a certain extent with the ink fountain roller, and is turned around the contacting part with the barrier plate stopper and detached from the outer peripheral surface of the ink fountain roller with the turning of the ink fountain member. When the barrier plate is detached from the fountain-forming face and the outer peripheral surface of the ink fountain roller, the barrier plate is easily removed by the barrier plate holding member and replaced. Therefore, automation of the replacement of the barrier plate is simplified.

A printing machine of claim 4, which is according to claim 3, is characterized in that the barrier plate stopper is also used as a cover for covering the upper portion of the ink fountain roller.

A printing machine of claim 5, which is according to claim 3, is characterized in that the ink fountain member is turned by the fountain-member turning device to be positioned at one of a plurality of work positions; a plurality of fountain-forming faces in which an ink channel-defining portion at the distal end comes close to the ink fountain roller and forms an ink fountain when positioned at each work position are formed on the periphery of the ink fountain member in the turning direction of the ink fountain member, and the distance from the central axis of rotation of the ink fountain member to each ink channel-defining portion differs from each other.

In this case, the work position of the ink fountain member is changed by simply turning the ink fountain member, and the distance from the central axis of rotation of the ink fountain member to the ink channel-defining portion is changed and the size of the ink channel is changed by simply changing the fountain-forming face forming the ink fountain.

A printing machine of claim 6, which is according to any one of claims 1 to 5, is characterized in that the ink supply device, comprising a level sensor for detecting the level of ink in the ink fountain, detects the level of ink in the ink fountain and supplies the ink to the portion of the ink fountain where the level of ink is lower than a predetermined value during printing operation.

In this case, the level of the ink in the ink fountain is maintained substantially constant during printing. Thus, a great amount of ink does not need to be placed in the ink fountain as in the prior art, and the level of ink in the ink fountain may be low so that the amount of ink to be placed in the ink fountain is small. The ink in the ink fountain is thus prevented from deteriorating and adversely affecting the printing quality. Furthermore, the amount of ink that becomes a waste in time of replacement is reduced, and the time required for collecting the remaining ink is reduced.

A printing machine of claim 7, which is according to any one of claims 1 to 5, is characterized in that the ink container has a bellows shape compressible in the vertical direction, a slit-like aperture that is normally closed is formed at a bottom wall of the container, and the portion of the slit-like aperture is opened by pressure when the upper portion of the ink container is pressed downward while holding the bottom of the ink container so that the ink in the ink container passes through the opened slit-like aperture portion and drops downward.

In this case, the ink is supplied to the ink fountain by simply moving the ink container above the ink fountain, and pushing the upper portion of the ink container. Therefore, the automation of supply of ink from the ink container to the ink fountain is simplified.

A printing machine of claim 8, which is according to claim 7, is characterized in that the ink supply device comprises, a moving body that moves above the ink fountain in a direction parallel to the ink fountain roller, container holders disposed on the moving body for holding and releasing the portion including the bottom of the ink container, and a pressing member disposed on the moving body for pushing downward the upper portion of the ink container held by the container holding members.

In this case, the desired ink container can be held and moved by the container holding members, and the desired ink can be supplied to the ink fountain by simply moving the desired ink container above the ink fountain and pressing the upper portion of the ink container with the pressing member. Therefore, automation of supply of ink from different ink containers to the ink fountain is simplified.

The printing machine of claim 9, which is according to claim 8, is characterized in that a level sensor for detecting the level of ink in the ink fountain is disposed in the moving body, the moving body moving above the ink fountain in a direction parallel to the ink fountain roller, detecting the level of ink in the ink fountain, and supplying the ink to the portion of the ink fountain where the level of ink is lower than a predetermined value during printing operation.

In this case, the level of ink in the ink fountain is maintained substantially constant during printing. Thus, a great amount of ink does not need to be placed in the ink fountain as in the prior art, and the level of ink in the ink fountain may be low so that the amount of ink to be placed in the ink fountain is small. The ink in the ink fountain is thus prevented from deteriorating and adversely affecting the printing quality. Furthermore, the amount of ink that becomes a waste in time of replacement is reduced, and the time required for collecting the remaining ink is reduced.

The printing machine of claim 10, which is according to any one of claims 1 to 9, is characterized in that a unit of a plurality of divided vibrating rollers is arranged between the ink fountain roller and an ink distributing roller on an printing portion side, the unit of a plurality of divided vibrating rollers comprising a plurality of vibrating rollers, which are lined in the axial direction of the ink fountain roller and freely rotated individually, and a change-over device for individually switching each vibrating roller between two positions between the ink fountain roller and the ink distributing roller so that the contact state with the two rollers change.

The amount of ink to be supplied to the printing surface is adjusted for each position of the vibrating roller, that is, for each position in the width direction of the printing surface by individually controlling the time during which each vibrating roller is switched to each position, thereby enhancing the printing quality.

For example, each vibrating roller is switched between a first position of contacting the ink fountain roller and not contacting the ink distributing roller, and a second position of contacting the ink distributing roller and not contacting the ink fountain roller. In this case, the ink applied to the outer peripheral surface of the ink fountain roller from the ink fountain is transferred to the vibrating roller while the vibrating roller is switched to the first position, and the ink transferred to the vibrating roller is transferred to the ink distributing roller while the vibrating roller is switched to the second position. The amount of ink to be supplied to the printing surface can be adjusted for each position of the vibrating roller by individually controlling the time during which each vibrating roller is switched to the first position and the second position.

The printing machine of claim 11, which is according to claim 10, is characterized in that the unit of a plurality of divided vibrating rollers comprises a support member fixed to a frame so as to be parallel to the ink fountain roller, a plurality of movable members of short circular cylinder shape attached to the support member so as to individually reciprocate in the same direction, a vibrating roller rotatably attached to the outer periphery of each movable member, and a change-over device, arranged on the support member, for individually switching the position of each movable member; and a change-over detection sensor for detecting the switching of the position of the movable member is disposed at the portion of the support member slidably contacting the movable member.

In this case, the change-over detection sensor detects if the switching of the position of the vibrating roller is not normally performed, in which case, for instance, a warning is given and the operation is stopped. Accordingly, unattended operation of the printing machine becomes possible, and occurrence of an abnormality such as production of defective goods etc. due to an abnormality in the switching of the position of the vibrating roller is prevented.

The printing machine of claim 12, which is according to claim 11, is characterized in that the change-over detection sensor is a magnetic sensor, and a permanent magnet is attached to the portion of the movable member facing the change-over detection sensor.

The positional relationship between the sensor and the permanent magnet is determined so that the output of the change-over detection sensor changes according to the position of the movable member.

In this case, to which position the movable member, that is, the vibrating roller is switched is reliably detected by the change-over detection sensor.

Effect of the Invention

According to the printing machine of claim 1, the replacement procedure is considerably automated, whereby significant simplification of the replacement procedure and reduction in time required for the replacement procedure are achieved, as described above.

According to the printing machine of claim 2, the deviation of the position of the barrier plate during printing is small or more or less eliminated, as described above.

According to the printing machine of claim 3, automation of replacement of the pair of barrier plates is simplified.

According to the printing machine of claim 4, the cover for covering the upper part of the ink fountain roller and the barrier plate stopper do not need to be separately arranged.

According to the printing machine of claim 5, the size of the ink channel is easily changed by simply turning the ink fountain member and changing the work position, as described above.

According to the printing machine of claim 6, the level of ink in the ink fountain is maintained substantially constant and the amount of ink to be placed in the ink fountain is reduced during printing, whereby the ink in the ink fountain is prevented from deteriorating and adversely affecting the printing quality, and furthermore, the amount of ink that becomes a waste in time of replacement is reduced and the time required for collecting the remaining ink is reduced, as described above.

According to the printing machine of claim 7, automation of supply of ink from the ink container to the ink fountain is simplified, as described above.

According to the printing machine of claim 8, automation of supply of ink from different ink containers to the ink fountain is simplified, as described above.

According to the printing machine of claim 9, the level of ink in the ink fountain is maintained substantially constant and the amount of ink to be placed in the ink fountain is reduced during printing, whereby the ink in the ink fountain is prevented from deteriorating and adversely affecting the printing quality, and furthermore, the amount of ink that becomes a waste in time of replacement is reduced and the time required for collecting the remaining ink is reduced, as described above.

According to the printing machine of claim 10, the amount of ink to be supplied to the printing surface can be adjusted for each position in the width direction of the printing-surface, thereby enhancing the printing quality, as described above.

According to the printing machine of claim 11, an abnormality in switching of the position of the vibrating roller is detected, and occurrence of an abnormality caused therefrom is prevented, as described above.

According to the printing machine of claim 12, to which position the vibrating roller is switched is reliably detected by the change-over detection sensor, as described above.

BRIEF DESCRIPTION OF THE DRAWINGS

The invention, together with objects and advantages thereof, may best be understood by reference to the following description of the presently preferred embodiment together with the accompanying drawings in which.

Figure 1:
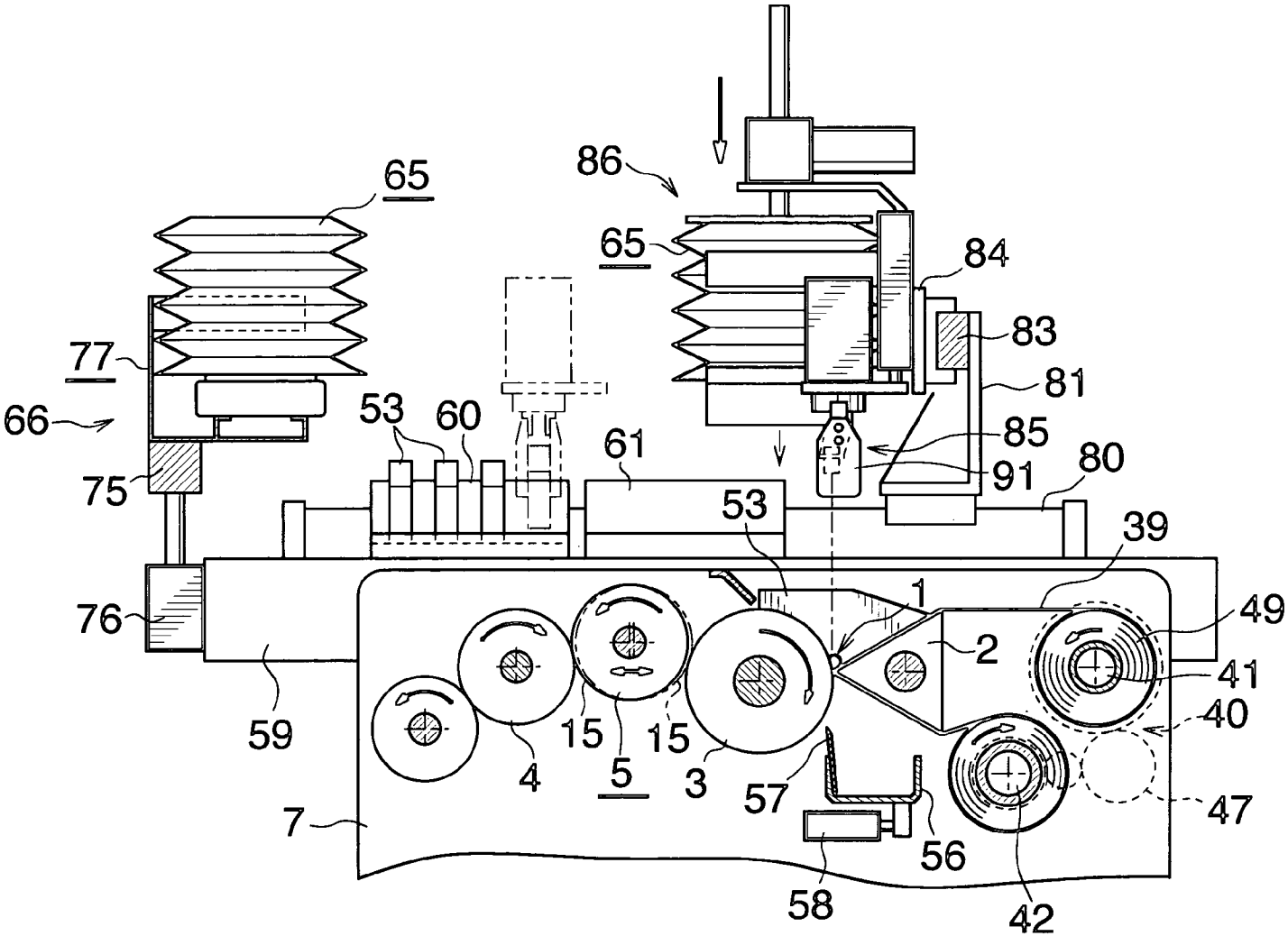
FIG. 1 is a schematic side view of the main parts of an inking arrangement of a printing machine.

DESCRIPTION OF SYMBOLS (1) ink fountain
(2) ink fountain member
(3) ink fountain roller
(4) ink distributing roller
(5) unit of a plurality of divided vibrating rollers
(6) support member
(7) frame
(8) movable member
(15) vibrating roller
(19) change-over device
(36) fountain-member turning device
(37*a*)(37*b*)(37*c*) fountain-forming face
(38*a*)(38*b*)(38*c*) ink channel-defining portion
(39) sheet
(40) sheet moving device
(52) ink channel
(53) barrier plate
(54) permanent magnet
(55) barrier plate attracting portion
(56) cleaning tank
(57) cleaning blade
(58) reciprocating device
(65) ink container
(72) bottom plate
(73) slit-like aperture
(84) moving body
(85) barrier plate replacing device
(86) ink supply device
(88) moving body
(91) barrier plate holding member
(93) container holding member
(99) pressing member
(101) level sensor
(102) change-over detection sensor
(103) permanent magnet
(104) ink fountain member
(105*a*)(105*b*)(105*c*)(105*d*) fountain-forming face
(106*a*)(106*b*)(106*c*)(106*d*) ink channel-defining portion
(107) ink fountain member
(108) fountain-forming face
(109) ink channel-defining portion
(110) cover

BEST MODE FOR CARRYING OUT THE INVENTION

The embodiment of the present invention will now be described with reference to the drawings.

Figure 2:
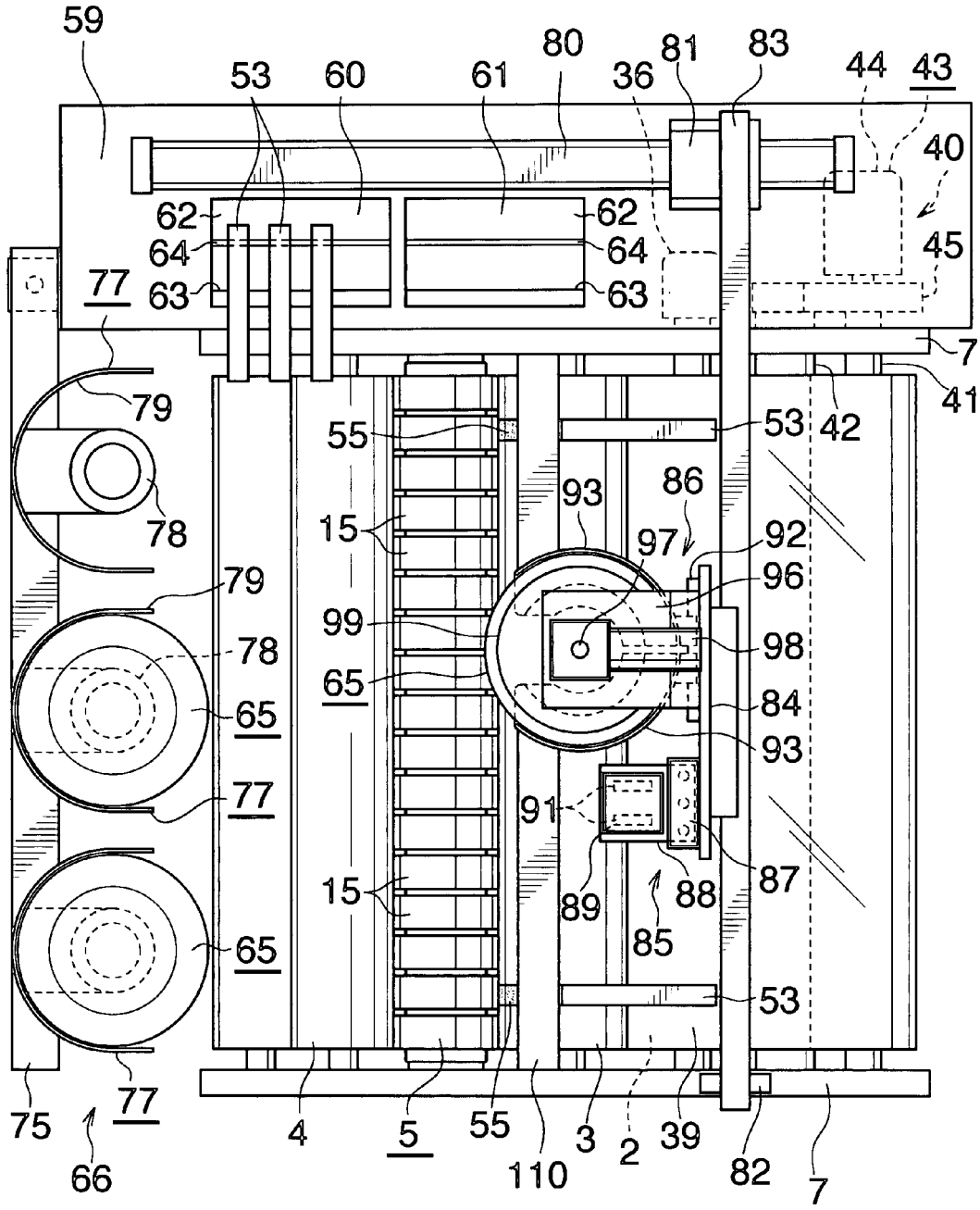
FIG. 2 is a plane view of FIG. 1.

FIG. 1 is a left side view schematically showing one part of an inking arrangement of the printing machine, and FIG. 2 is a plane view of the same. In the following description, the right side of FIGS. 1 and 2 is the front, the left side is the back, and the right and left sides when seen from the front is the right and the left.

In FIGS. 1 and 2, a first ink distributing roller (4) of the plurality of ink distributing rollers is arranged behind an ink fountain roller (3) close to the back end of an ink fountain member (2) forming an ink fountain (1), and a unit (5) of a plurality of divided vibrating rollers is arranged between the fountain roller (3) and the distributing roller (4). The axes of the fountain roller (3) and the distributing roller (4) are parallel to each other and extend in the right-left direction. The fountain roller (3) and the distributing roller (4) are rotatably supported by a frame (7) of the printing machine, and are rotated in the direction of arrows as shown in FIG. 1 at a predetermined rotation speed by an unillustrated driving device. The rotation speed of the fountain roller (3) is about 1/10 of that of the distributing roller (4).

Figure 3:
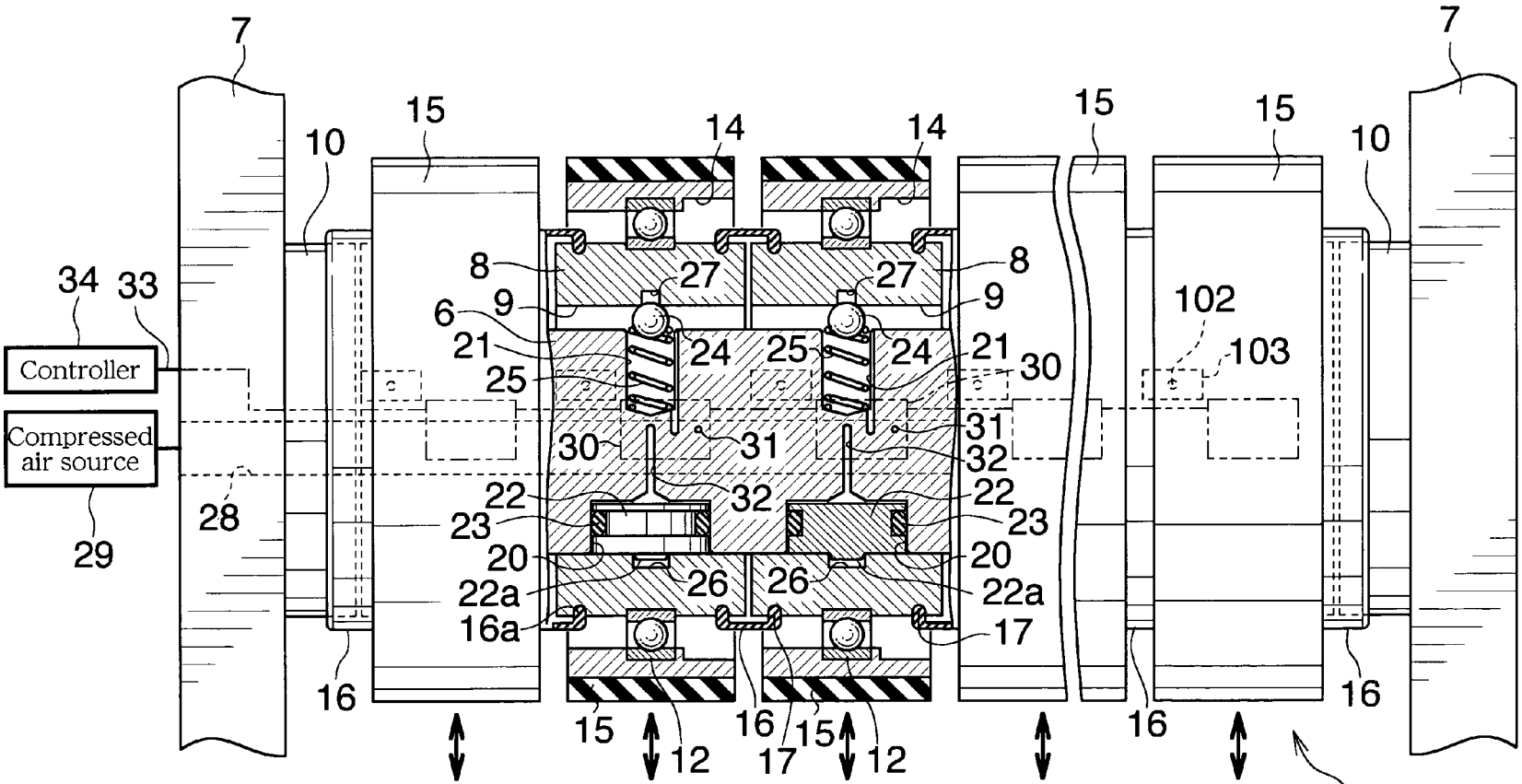
FIG. 3 is a partially cut-out plane view of a portion of a unit of a plurality of divided vibrating rollers.
Figure 4:
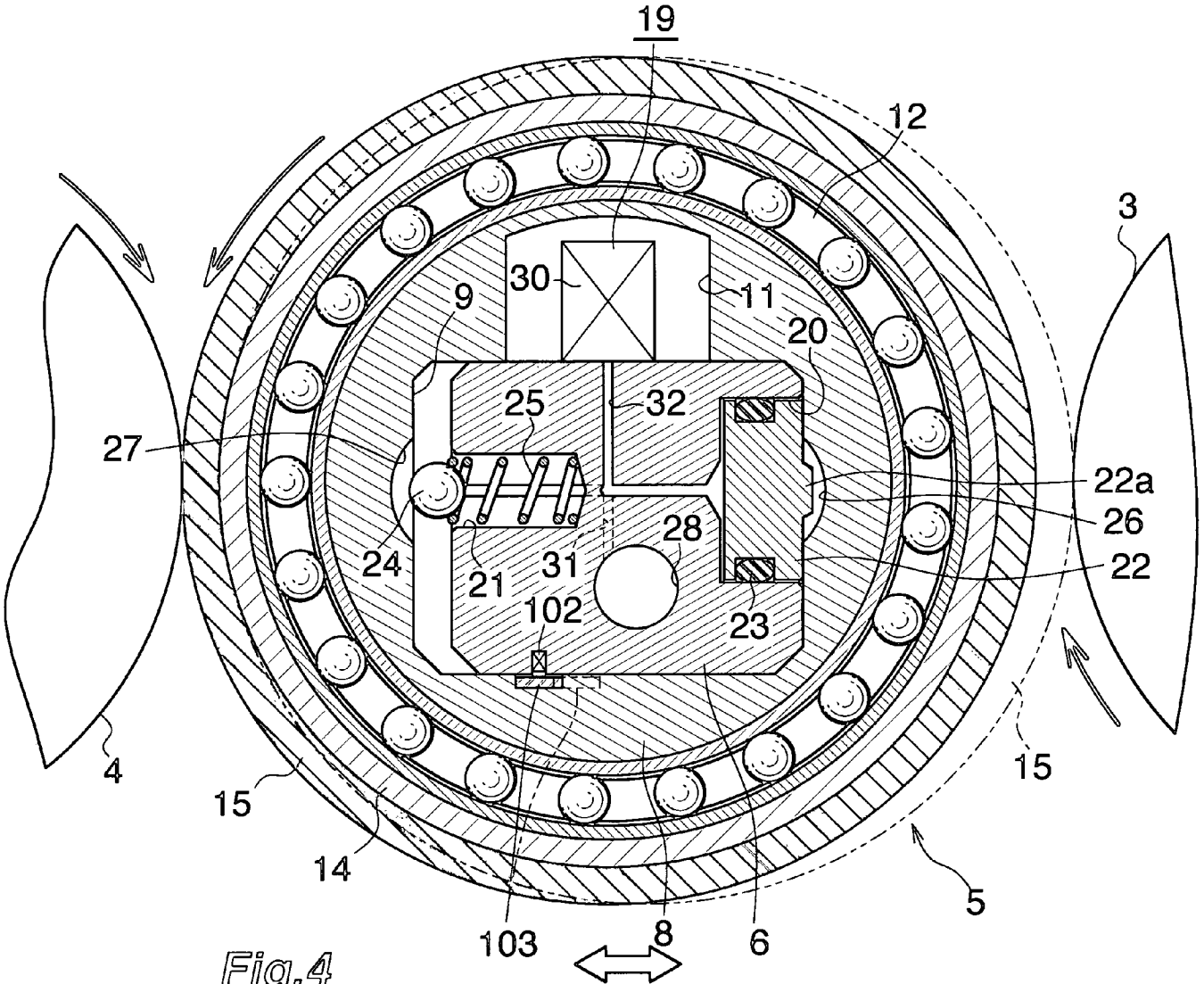
FIG. 4 is a traverse cross sectional view of FIG. 3.

The details of the vibrating-roller unit (5) are shown in FIGS. 3 and 4. FIG. 3 is a partially cut-out plane view of the vibrating-roller unit (5), where the lower side of the figure is the front and the upper side is the back. FIG. 4 is an enlarged traverse cross sectional view of one part of FIG. 2 seen from the left side.

Both right and left ends of a linear support member (6) parallel to the rollers (3), (4) are fixed to the frame (7) and a plurality of movable members (8) are attached to the periphery of the support member (6). The support member (6) has a prism column shape with the front-to-back width being slightly larger than the top-to-bottom width. The movable member (8) has a short circular cylinder shape, and a relatively large rectangular bore (9) is formed in the movable member (8) passing therethrough in the axial direction. The plurality of movable members (8) are arranged in the axial direction between a pair of opposed short cylindrical fixed members (10), which are fixed to the frame (7) so as to face each other and passed through by the support member (6), and the support member (6) passes through the bores (9) of the movable members (8). The top-to-bottom width of the bores (9) of the movable members (8) is substantially the same as the top-to-bottom width of the support member (6), and both upper and lower surfaces of the bore (9) slidably contact the upper and lower surfaces of the support member (6). The front-to-back width of the bore (9) is slightly larger than the front-to-back width of the support member (6), so that the movable member (8) moves back and forth with respect to the support member (6) between a front end position where the rear surface of the bore (9) contacts the rear surface of the support member (6) and a back end position where the front surface of the bore (9) contacts the front surface of the support member (6). A rectangular groove (11) is formed over the entire length of the movable member (8) on the upper surface of the bore (9) of the movable member (8) that slidably contacts the support member (6).

Each movable member (8) is positioned in the axial direction with respect to the support member (6), as hereinafter described, and a slight gap is formed in the axial direction between the adjacent movable members (8) and between the movable members (8) at both ends and the fixed members (10) at both ends respectively. Each movable member (8) thus moves individually in the front-back direction with respect to the support member (6).

An inner ring of a ball bearing (12), which is a rolling bearing, is fixed at the outer periphery of each movable member (8). A metal sleeve (14) is fixed to the outer periphery of the outer ring of each ball bearing (12), and a vibrating roller (15) of thick walled cylinder shape made of rubber is fixed to the outer periphery of the sleeve (14).

A dustproof member (16) of short circular cylinder shape is fitted to cover the outer peripheries between the adjacent movable members (6). The dustproof member (16) is made by an appropriate rubberlike elastic material such as natural rubber, synthetic rubber, and synthetic resin, and flange portions (16*a*) that slightly protrude towards the inner side are integrally formed at both ends. The dustproof member (16) is fixed to the movable member (8) by fitting the flange portions (16*a*) to annular grooves (17) formed in the outer peripheral surface of the portion closer to right and left ends of the movable member (8). The dustproof member (16) is similarly fitted to cover the outer peripheries between the movable members (8) at right and left ends and the fixed members (10) adjacent thereto respectively.

A change-over device (19) for switching the position of the vibrating roller (15) is arranged on the support member (6) side between each movable member (8) and the support member (6) in the following manner.

At the portion of the support member (6) corresponding to the central part in the axial direction of the movable member (8), a cylinder portion (20) is formed by forming a hole extending slightly to the back side from the front surface, and a spring cavity (21) extending slightly to the front side from the back side is also formed. The center of the cylinder portion (20) and the center of the spring cavity (21) are on one line extending in the front-back direction in the vicinity of the center in the top-to-bottom direction of the movable member (8). A piston (22) of short circular cylinder shape is inserted into the cylinder portion (20) by way of an O-ring (23) so as to be slidable in the front-back direction. A ball (24) serving as a biasing member is inserted to the spring cavity (21) so as to be slidable in the front-back direction, and a compression coil spring (25) for biasing the same in the backward direction is also inserted thereinto.

Recesses (26), (27) are respectively formed at the front surface of the bore (9) of the movable member (8) facing the center of the piston (22) and the rear surface of the bore (9) facing the center of the ball (24). The width in the axial direction of the movable member (8) of each recess (26), (27) is constant. The cross sectional shape of each recess (26), (27) at the cross section orthogonal to the axis line of the movable member (8) is uniform, and has a circular arc shape having a line parallel to the axis line as the center. A tapered projection (22*a*) is formed at the center of the end face of the piston (22) facing the recess (26), and the projection (22*a*) is fitted into the recess (26). The length of the portion excluding the projection (22*a*) of the piston (22) is slightly shorter than the length of the cylinder portion (20), and the most part of the projection (22*a*) projects out from the front surface of the support member (6) even if the piston (22) is inserted farthest into the cylinder portion (20). Part of the outer periphery of the ball (24) is fitted to the recess (27).

At the back part of the support member (6), the ball (24) is constantly pressed against the rear surface of the bore (9) of the movable member (8) by the elastic force of the spring (25), and part of the outer periphery of the ball (24) is fitted to the recess (27) and pressed against the front and back rims of the recess (27). At the front part of the support member (6), on the other hand, the front surface of the support member (6) or the piston (22) is pressed against the front surface of the bore (9) of the movable member (8), and the most part of the projection (22*a*) of the piston (22) is fitted to the recess (26). The positioning in the axial direction of the movable member (8) with respect to the support member (6) is performed as the most part of the projection (22*a*) of the piston (22) and one part of the ball (24) are constantly fitted to the recesses (26), (27).

An air supply channel (28) is formed in the support member (6) extending from the left end thereof in the axial direction and closing near the right end, and the open end at the left end of the channel (28) is connected to a compressed air source (29) by way of an appropriate piping.

A switching valve (solenoid valve) (30) is attached to the upper surface of the support member (6) facing the groove (11) of the movable member (8), and the two ports of the valve (30) are respectively communicated to the air supply channel (28) and the cylinder portion (20) by way of communicating channels (31), (32) formed in the support member (6). An electric wire (33) of the valve (30) is led to the outside through the groove (11) portion, and is connected to a controller (34).

The cylinder portion (20) is communicated to the air supply channel (28) by way of the valve (30) when the valve is in an energized state (on state), and the cylinder portion (20) is communicated to atmospheric air by way of the valve (30) when the valve is in an unenergized state (off state). The position in the front-back direction of each vibrating roller (15) is individually switched by individually switching the state of current flow to the valve (30) of each change-over device (19) with the controller (34).

When the valve (30) is switched to the off state, the cylinder portion (20) is communicated to atmospheric air, and thus the piston (22) is able to freely move inside the cylinder portion (20). The movable member (8) is thus moved to the back side through the ball (24) by the spring (25). Consequently, the movable member (8) and the vibrating roller (15) are switched to the back end position, and the vibrating roller (15) moves away from the fountain roller (3) and presses against the distributing roller (4).

When the valve (30) is switched to the on state, the cylinder portion (20) is communicated to the air supply channel (28) and further to the compressed air source (29) therethrough, and thus compressed air is supplied to the cylinder portion (20). The piston (22) thus projects forward from the support member (6) against the force of the spring (25), whereby the movable member (8) is moved forward. Consequently, the movable member (8) and the vibrating roller (15) are switched to the front end position, and the vibrating roller (15) moves away from the distributing roller (4) and presses against the fountain roller (3).

A change-over detection sensor (102) comprising a magnetic sensor is fixed in an embedded manner at the lower surface of the support member (6) that slidably contacts the bottom wall of the bore (9) of the movable member (8), and a permanent magnet (103) is fixed in an embedded manner at the bottom wall of the bore (9) of the movable member (8) facing thereto. The lower surface of the sensor (102) is in plane with the lower surface of the support member (6), or is positioned slightly inward (upper side). The upper surface of the permanent magnet (103) is in plane with the bottom wall surface of the bore (9) of the movable member (8), or is positioned slightly inward (lower side). The sensor (102) faces the central part in the front-back direction of the permanent magnet (103) when the movable member (8) is switched to the back end position, and the sensor (102) is deviated backwards from the permanent magnet (103) when the movable member (8) is switched to the front end position. Therefore, the output of the sensor (102) changes depending on the position of the movable member (8), and which position the movable member (8), that is, the vibrating roller (15) is at is recognized from the output of the sensor (102).

As hereinafter described, the ink applied to the outer peripheral surface of the fountain roller (3) from the ink fountain (1) is transferred to the vibrating roller (15) while the vibrating roller (15) is switched to the front end position, and the ink transferred to each vibrating roller (15) is transferred to the distributing roller (4) while the vibrating roller (15) is switched to the back end position. The ink transferred to the distributing roller (4) is further supplied to the printing surface through a plurality of other ink distributing rollers and the like. The amount of ink supplied to the printing surface is adjusted by the position in the width direction by controlling the time switched to the front end position and the back end position for each vibrating roller (15) with the controller (34). Whether or not the switching of the position of the vibrating roller (15) is normal is detected by the output of the sensor (102), and a warning is given if the vibrating roller (15) is not normally switched.

Figure 5:
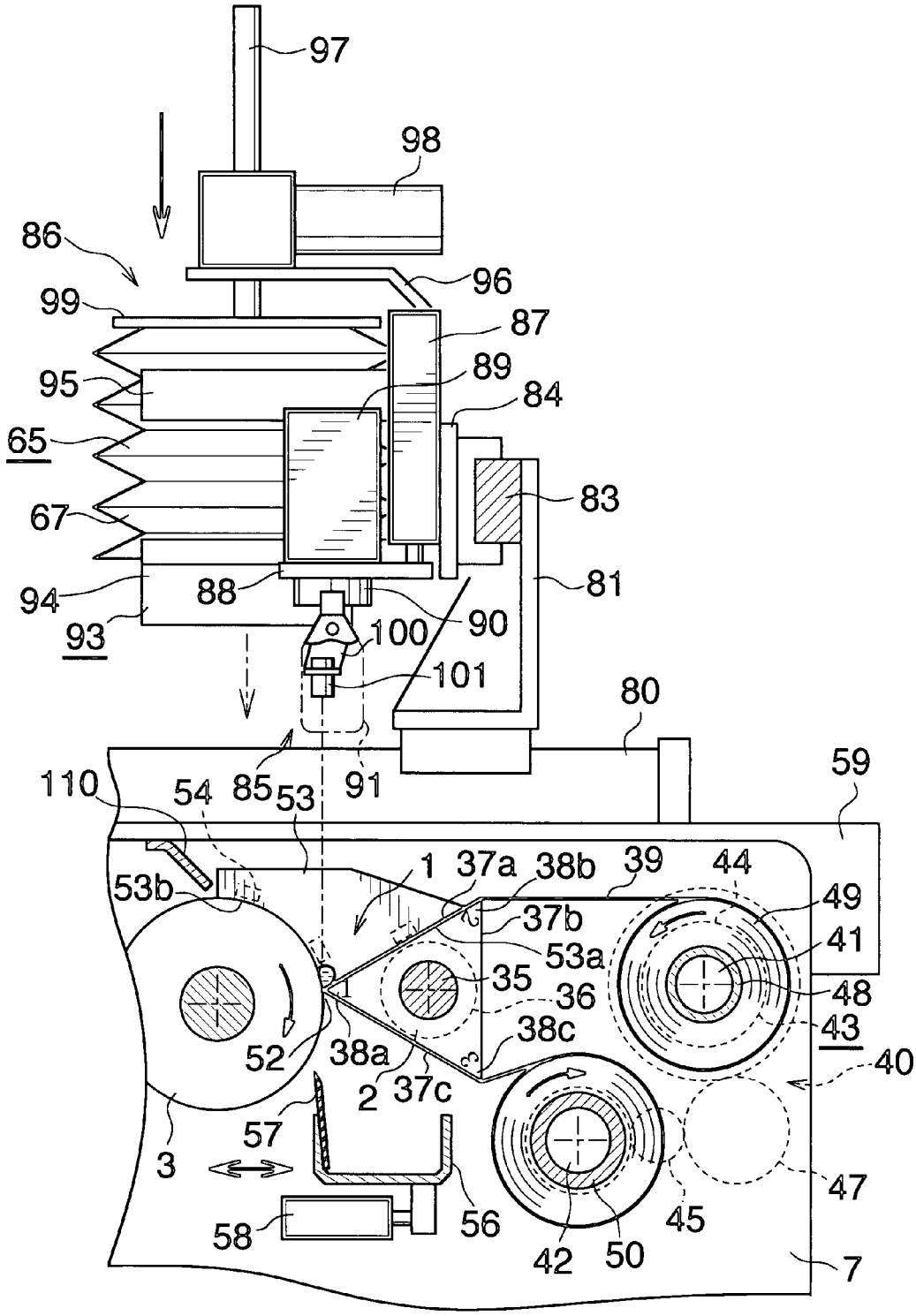
FIG. 5 is a view showing one part of FIG. 1 in an enlarged manner.
Figure 6:
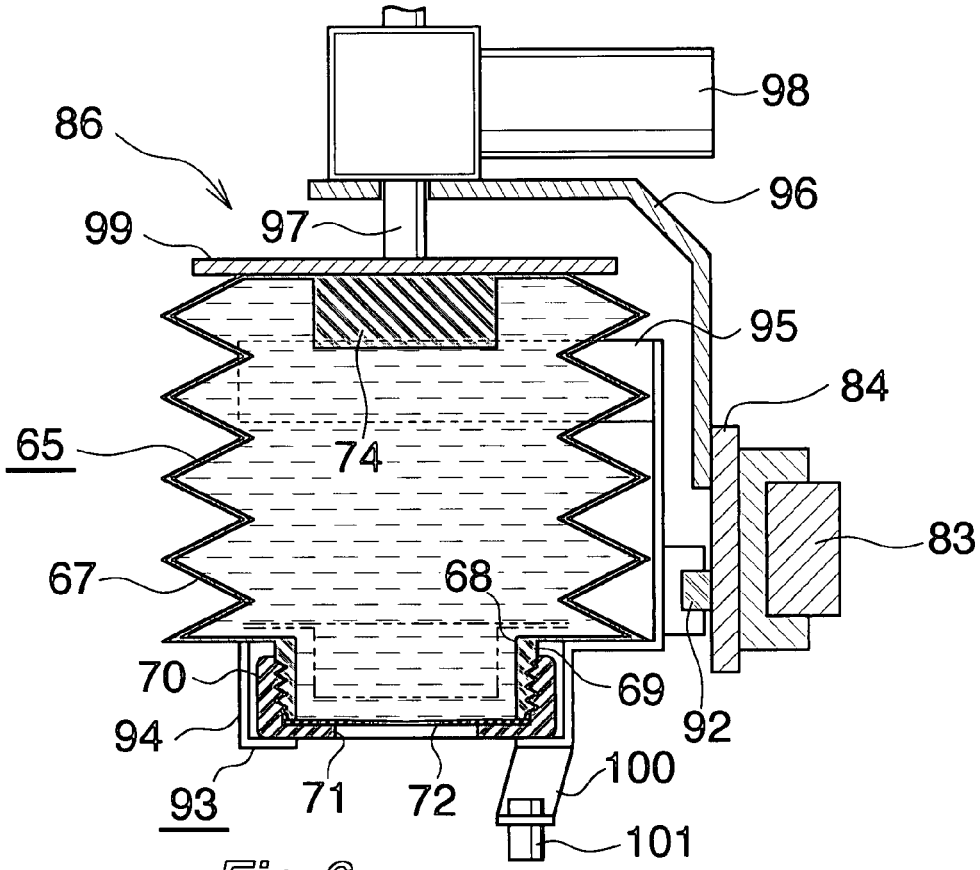
FIG. 6 is a longitudinal cross sectional view showing an ink container and the portion of the ink supply device.
Figure 7:
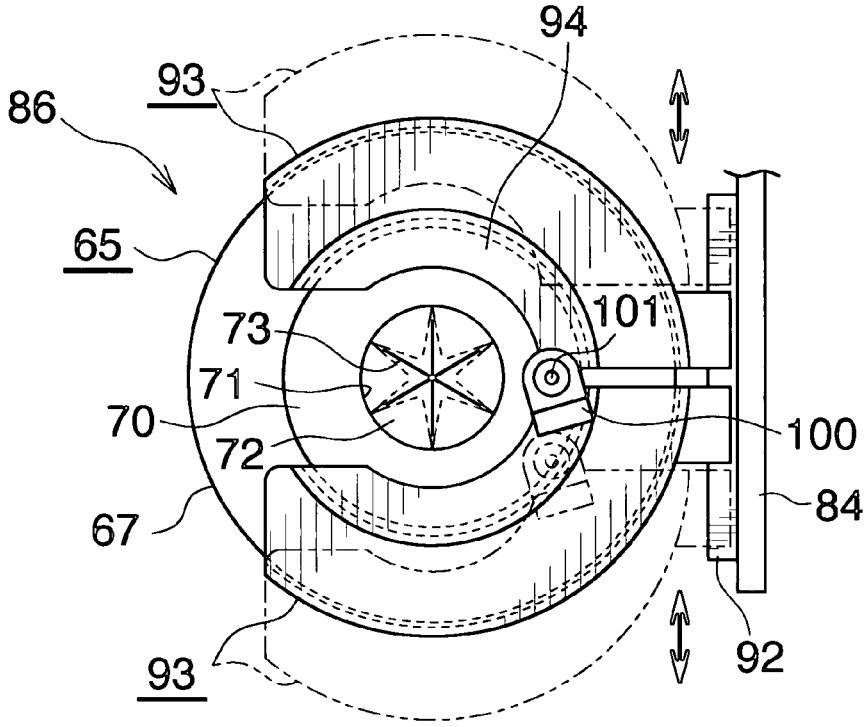
FIG. 7 is a bottom view of FIG. 6.

FIG. 5 is a view showing part of FIG. 1 in an enlarged manner, and FIGS. 6 to 10 are views showing each part of the ink supply device in detail.

The ink fountain member (2) has a triangular prism shape having a cross section of an equilateral triangle and the like, and a support shaft portions (35) of circular cylinder shape arranged on both right and left ends are rotatably supported by the frame (7). An ink fountain member turning device (36) comprising an electric motor is arranged in the frame (7), and the ink fountain member (2) is turned, positioned at one of three work positions at an angular spacing of 120 degrees, and fixed at each work position by the turning device (36).

The three side surfaces of the periphery of the ink fountain member (2) serve as fountain-forming faces (37*a*), (37*b*), (37*c*), and the ridge lines at the ends in the counterclockwise direction of each fountain-forming face (37*a*), (37*b*), (37*c*) serve as the ink channel-defining portions (38*a*), (38*b*), (38*c*) corresponding to the fountain-forming faces (37*a*) to (37*c*) respectively. The fountain-forming faces will be designated collectively by the reference numeral (37), and when there arises a need to make distinction, these faces will be referred to as first fountain-forming face (37*a*), second fountain-forming face (37*b*), and third fountain-forming face (37*c*) as arranged counterclockwise in order. Similarly, the ink channel-defining portions will be designated collectively by the reference numeral (38), and when there is a need for distinction, these portions will be referred to as first ink channel-defining portion (38*a*), second ink channel-defining portion (38*b*), and third ink channel-defining portion (38*c*) in the order of counterclockwise arrangement. The end face of the ink fountain member 2 is marked with the numerals 1 to 3 in corresponding relation with the ink channel-defining portions 38 to represent the respective portions 38.

A sheet moving device (40) for feeding and winding a strip of sheet (39) is arranged in the vicinity of the ink fountain member (2).

The sheet moving device (40) comprises a feed shaft (41), a take-up shaft (42), and a shaft driver (43) for driving the shafts (41), (42). The shaft driver (43) comprises an electric motor (44) for driving the feed shaft (41) and a power transmission mechanism (45) for transmitting the rotation of the motor (44) to the take-up shaft (42), where the feed shaft (41) rotates at a constant speed smaller than the rotation speed of the take-up shaft (42). A slide mechanism (47) that applies friction resistance and allows sliding is arranged at the power transmission mechanism (45). For example, the power transmission mechanism (45) includes gear trains, and the slide mechanism (47) is combined so that a first gear engaging with the gears on the motor (44) side and a second gear engaging with the take-up shaft (42) side overlap each other, and rotate while sliding with respect to each other with a predetermined friction resistance.

A core tube (48) of the sheet roll (49) in which a strip of sheet (39) made of plastic and the like is wound around the core tube (48) made of aluminum alloy and the like is removably fixed to the feed shaft (41). The sheet take-up member (50) of cylinder shape is removably fixed to the take-up shaft (42). Although not shown, a take-up tube made of plastic and the like is fitted to the outer periphery of the sheet take-up member (50) so as not to rotate with respect to each other.

The sheet (39) fed from the sheet roll (49) fixed to the feed shaft (41) is placed over the ink fountain member (2) so as to cover the fountain-forming face (37), and thereafter, guided to the take-up tube fitted to the sheet take-up member (50), where the distal end of the sheet (39) is fixed to the take-up tube by an appropriate means.

The relationship of the rotation speeds of the feed shaft (41) and the take-up shaft (42) is defined so that the movement speed of the sheet (39) at the portion of the sheet take-up member (50) is greater than the movement speed of the sheet (39) at the portion of the sheet roll (49) of the feed shaft (41) when assumption is made that sliding is not provided by the slide mechanism (47) even if the outer diameter of the sheet (39) wound around the sheet take-up member (50) is the smallest.

The sheet (39) is fed from the sheet roll (49), moved along the ink fountain member (2) in the longitudinal direction and wound by the sheet take-up member (50) by driving the feed shaft (41) and the take-up shaft (42) with the motor (44). Since the relationship of the rotation speeds of the feed shaft (41) and the take-up shaft (42) is defined as above, and the slide mechanism (47) is arranged between the motor (44) and the take-up shaft (42), the sheet (39) is moved while constantly being applied with tensile force. Thus, when the motor (44) is stopped, the portion of the sheet (39) covering the fountain-forming face (37) is held in intimate contact with the fountain-forming face (37).

Each fountain-forming face (37) of the ink fountain member (2) forms the ink fountain (1) when the ink fountain member (2) is positioned at the corresponding work position. In practice, the portion of the sheet (39) covering the fountain-forming face (37) and the outer peripheral surface of the fountain roller (3) form the ink fountain (1). The ink channel-defining portion (38) corresponding to the fountain-forming face (37) comes closer to the outer peripheral surface of the fountain roller (3) by way of the sheet (39), thereby forming an ink channel (52) between the portion of the sheet (39) in intimate contact with the ink channel-defining portion (38) and the outer peripheral surface of the fountain roller (3).

The size of the ink channel (52) is determined by the distance between the central axis of rotation of the fountain roller (3) and the central axis of rotation of the ink fountain member (2), the diameter of the fountain roller (3), and the distance from the central axis of rotation of the ink fountain member (2) to the ink channel-defining portion (38). In this example, three ink channel-defining portions (8) are different in distance from the central axis of rotation of the ink fountain member (2) to the ink channel-defining portion (38). The size of the ink channel thus differs depending on the work position.

A pair of right and left barrier plates (53) serving as the side plates of the ink fountain (1) are removably fixed in a space between the ink fountain member (2) and the fountain roller (3). Each barrier plate (53) has a substantially triangular shape. The portions corresponding to the two sides of the triangle are formed with a flat fountain member attracting face (53*a*) that is in intimate contact with the fountain-forming face (37) and a fountain roller attracting face (53*b*) having a concave portion of cylindrical surface shape that is in intimate contact with the outer peripheral surface of the fountain roller (3). Attracting permanent magnets (54) are fixed in an embedded manner in the vicinity of the two attracting surfaces (53*a*), (53*b*) of each barrier plate (53).

A barrier plate attracting portion (55) having the entire periphery made of magnetic material is arranged at two locations closer to both right and left ends on the outer periphery of the fountain roller (3), and the portions other than the attracting part (55) is made of non-magnetic material. The width of the attracting portion (55) is substantially the same as the width of the barrier plate (53). Each fountain-forming face (37) of the ink fountain member (2) may be entirely made of magnetic material or may have only the portion corresponding to the attracting portion (55) of the fountain roller (3) made of magnetic material and the remaining portion made of non-magnetic material.

The barrier plate (53) has the fountain roller attracting surface (53*b*) being in intimate contact with the attracting portion (55) of the fountain roller (3) and attracted thereto by magnetic force and the ink fountain attracting face (53*a*) being in intimate contact with the fountain-forming face (37) by way of the sheet (39) and attracted thereto by magnetic force so as to be fixed to the fountain roller (3) and the fountain-forming face (37), thereby forming the side plates of the ink fountain. The barrier plates (53) are merely attracted to the fountain roller (3) by magnetic force, and are therefore unlikely to cause trouble to the rotation of the fountain roller (3).

A cleaning tank (56) is disposed below and in front of the fountain roller (3). A cleaning blade (57) projecting obliquely backwardly upward from the upper end of the back wall of the tank (56) is fixed to the back part of the tank (56). The width in the right-to-left direction of the tank (56) and the blade (57) is greater than the length in the right-left direction of the fountain roller (3). The tank (56) and the blade (57) are moved forward and rearward by a reciprocating device (58) comprising an air cylinder, and is switched between a cleaning position at the back end where the upper end of the blade (57) is in pressing contact with the outer peripheral surface of the fountain roller (3) and a stand-by position at the front end where the blade (57) is away from the fountain roller (3).

A supporting table (59) of horizontal plate shape, which is long in the front-back direction, is disposed at the upper part on the right side of the frame (7), and a first barrier plate rest (60) on which new barrier plates (53) before use are mounted and a second barrier plate rest (61) on which barrier plates (53) after use are mounted are disposed on the upper surface of the support table (59). A first receiving part (62) having a convex portion of cylindrical surface shape for receiving the fountain roller attracting face (53*b*) of the barrier plate (53) and a second receiving part (63), projecting from the lower part of the first receiving part (62), for receiving the portion of the ink fountain attracting surface (53*a*) of the barrier plate (53) on the fountain roller attracting face (53*b*) side are disposed in each table (60), (61). A rod shaped magnetic member (64) is fixed in an embedded manner at the upper part of the first receiving part (62).

A container storage unit (66) for storing a plurality of ink containers (65) is disposed at the back part of the frame (7).

The ink container (65) comprises a container main body (67) made of flexible plastic. The container main body (67) has a bellows shape having a horizontal cross section of a circle and being compressible in vertical direction. The upper wall and the lower wall of the bellows shaped portion of the container main body (67) form a horizontal circular disc shape. A circular hole (68) is formed at the lower wall of the container main body (67), and the tubular portion (69) projecting downward from the peripheral edge of the hole (68) is integrally formed. A male thread is formed at the outer periphery of the tubular portion (69), and a bottom lid (70) of short cylinder shape is screw fit and fixed to the relevant portion from below. A circular hole (71) is formed in the bottom wall of the bottom lid (70). A bottom plate (72) of a thin circular disc shape made of plastic having a large elastic coefficient is fitted into the bottom lid (70), so that the outer peripheral edge of the bottom plate (72) is sandwiched between the bottom wall of the bottom lid (70) and the lower end face of the tubular portion (69) of the container main body (67). The portion of the bottom plate (72) facing the hole (71) of the bottom lid (70) constitutes the bottom wall of the container (65). The thickness of the bottom plate (72) becomes thinner towards the center, and a slit-like aperture (73) is formed in the bottom plate (72). In this example, six slit-like apertures (73) radially extending from the center of the bottom plate (72) are formed. A block (74) of short circular cylinder shape is integrally formed at the inner surface (lower surface) of the upper wall of the container main body (67). The outer diameter of the block (74) is slightly smaller than the inner diameter of the tubular portion (69), and the length (height) of the block (74) is slightly smaller than the length of the tubular portion (69).

Normally, different types of ink are accommodated in each container (65). The portion of the slit-like aperture (73) is closed when pressure is not applied to the upper portion of the container (65), whereby the ink will not be discharged to the outside through the closed aperture. As hereinafter described, when the upper portion of the container (65) is pressed downward with the bottom of the container (65) fixed, the slit-like aperture (73) portion opens by such pressure, and the ink in the container (65) drops downward through the portion of the opened slit-like aperture (73).

The container storage unit (66) comprises a support member (75) extending horizontally in the right-left direction. The right end of the supporting member (75) is supported by the back end of the supporting table (59) by way of a raising and lowering device (76) using an air cylinder. A plurality of container holders (77) are disposed in the right-left direction on the supporting member (75). Each container holder (77) comprises a bottom receiving part (78) for receiving the bottom of the container (65) from below, and a middle holding part (79) of substantially semicircular shape for holding the middle part of the container (65) as held by the back thereof.

A guide rail (80) extending horizontally in the front-back direction is disposed on the upper surface of the supporting table (59) at the portion on the right side from the barrier plate rests (60), (61), and the lower part on the right side of a first moving body (81) having a gate shape is guided by the guide rail (80). A roller (82) disposed at the lower part on the left side of the moving body (81) is placed on the upper surface of the left side portion of the frame (7). Although not shown, the moving body (81) is moved in the front-back direction by a driving device using the ball screw and the like.

A guide rail (83) extending horizontally in the right-left direction is disposed at the rear surface on the upper part of the first moving body (81), and a second moving body (84) is guided by the guide rail (83). Although not shown, the moving body (84) is moved in the right-left direction by a driving device using the ball screw and the like.

The main parts of a barrier plate replacing device (85) and an ink supply device (86) are disposed in the portion of the second moving body (84).

The barrier plate replacing device (85) is configured as below.

A cover (110) also used as a barrier plate stopper is disposed at a position close to the upper part of the fountain roller (3), the position being slightly backward from the back end of the barrier plate (53) attracted to the fountain roller (3) and the fountain-forming face (37). The cover (110) has both right and left ends fixed to the frame (7), and covers the entire length of the upper part of the fountain roller (3).

A third moving body (88) of horizontal plate shape is supported by the rear surface of the second moving body (84) by way of the raising and lowering device (87) using the air cylinder, and a pivoting/opening and closing device (89) using air pressure is disposed in the moving body (88). A pair of barrier-plate holding members (91) that freely opens and closes is disposed at the lower end of a vertical pivot shaft (90) projecting downward from the pivoting/opening and closing device (89). The holding member (91) is moved in the front-back direction and in the right-left direction by the movement of the first and second moving bodies (81), (84), and raised and lowered by the raising and lowering of the third moving body (88). The holding member (91) is pivoted about the center of the vertical axis by the pivot of the pivot shaft (90) by the pivoting/opening and closing device (89), and is opened and closed by the pivoting/opening and closing device (89).

The ink supply device (86) is configured as below.

A guide rail (92) extending horizontally in the right-left direction is disposed at the rear surface of the second moving body (84), and a pair of right and left container holding members (93) are guided by the guide rail (92). Each of the right and left holding members (93) is symmetric to each other in construction. A bottom holding part (94) for sandwiching the portion of the bottom lid (70) of the container (65) from both right and left sides and holding the outer periphery part of the bottom surface of the bottom lid (70) from below, and a middle holding part (95) for sandwiching and holding the middle part of the container (65) from both right and left sides are disposed in the holding members (93). Although not shown, each of the right and left holding members (93) is symmetrically moved and opened and closed by the driving device using air cylinder. A vertical raising and lowering rod (97) is supported in a freely raising and lowering manner at the portion of the bracket (96) extending upward from the upper part of the second moving body (84) and protruding horizontally above the holding members (93), and is raised and lowered by the raising and lowering device (98). A pressing member (99) of horizontal circular disc shape is fixed to the lower end of the raising and lowering rod (97) projecting downward from the bracket (96). A level sensor (101) for detecting the level of the ink in the ink fountain (1) is disposed at the distal end of the bracket (100) fixed to the bottom surface of the bottom holding part (94) of one holding member (93). An ultrasonic sensor or the like is used for the level sensor (101).

When the container (65) is held by the pair of holding members (93), the portion of the slit-like aperture (73) of the container (65) is closed and the ink will not be discharged to the outside if the pressing member (99) is not pressing downward the upper portion of the container (65). When the pressing member (99) presses the upper portion of the container (65) downward, the portion of the slit-like aperture (73) opens by the relevant pressure, and the ink drops downward. The ink drops on the outer peripheral surface of the fountain roller (3) slightly above the ink channel (52). The ink dropped onto the outer peripheral surface of the fountain roller (3) moves to the ink channel (52) by the rotation of the fountain roller (3), and retains in the ink fountain (1).

The level of the ink in the ink fountain (1) is detected by the level sensor (101) while reciprocating the ink supply device (86) to the left and the right at a predetermined speed, and the ink is supplied to the portion of the ink fountain (1) where the level of the ink is lower than a predetermined value, whereby the level of the ink in the ink fountain (1) is maintained substantially constant.

The barrier plate (53) is not attached to the fountain roller (3) and the fountain-forming face (37), and two or more new barrier plates (53) are mounted on the first barrier-plate rest (60) before starting printing. Furthermore, the container (65) is not held by the ink supply device (86), but the container (65) is held by the container holder (77). The portion of the middle part of the sheet (39) before use fed from the sheet roll (49) and wound around the sheet take-up member (50) is in intimate contact with the fountain-forming face (37) of the ink fountain member (2) positioned at a predetermined work position. In this case, the ink fountain member (2) is positioned at the first work position, and the sheet (39) is in intimate contact with the first fountain-forming face (37*a*).

In the circumstances described above, first, the barrier-plate holding members (91) of the barrier plate replacing device (85) holds one barrier plate (53) on the first barrier-plate rest (60), the barrier plate is attracted to one of the barrier plate attracting portion (55) of the fountain roller (3) and the fountain-forming face (37*a*) corresponding thereto, and thereafter another barrier plate (53) is similarly attracted to the other barrier plate attracting portion (55) of the fountain roller (3) and the fountain-forming face (37*a*) corresponding thereto.

Figure 8:
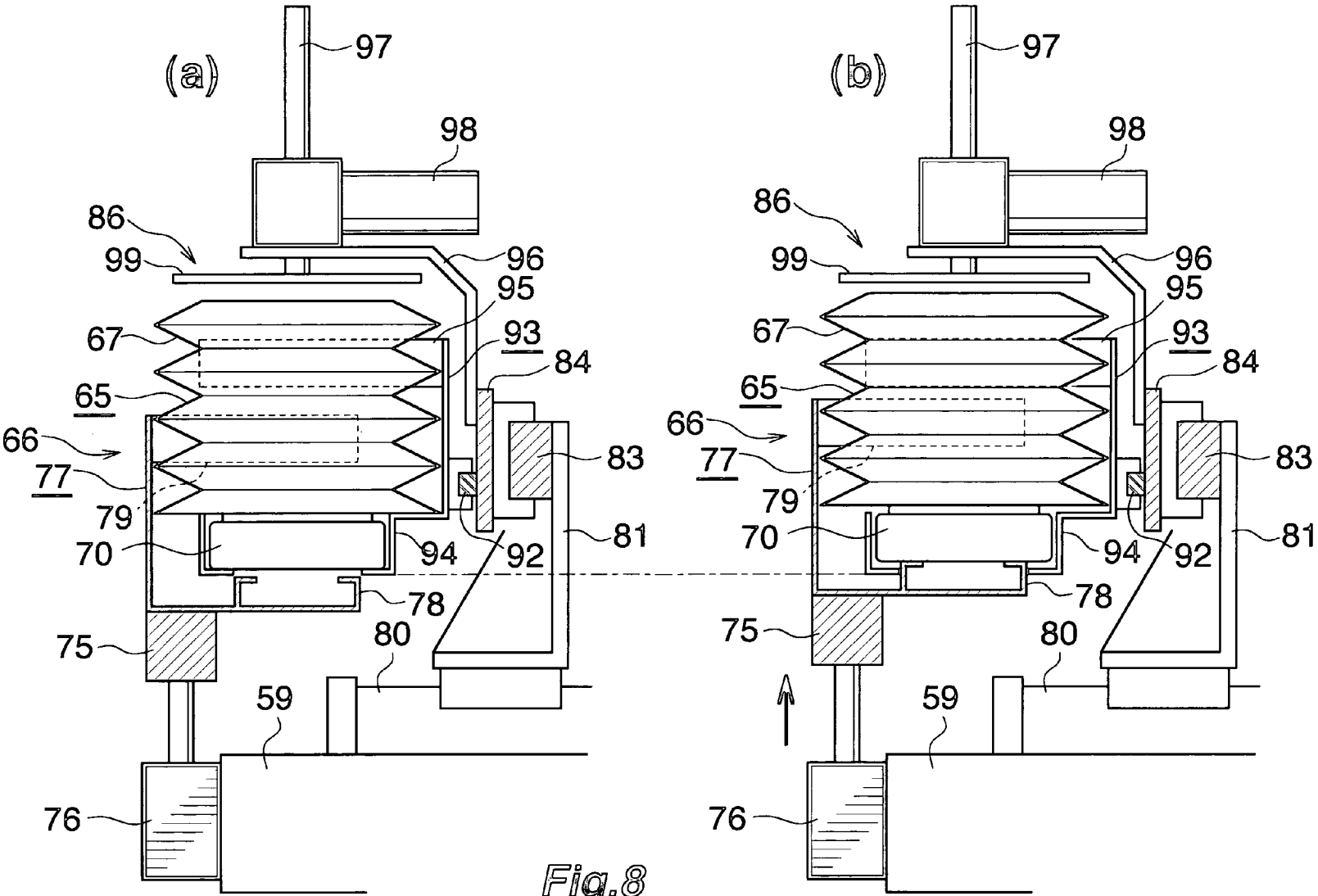
FIG. 8 is a side view showing the ink container and the portion of the ink supply device.
Figure 9:
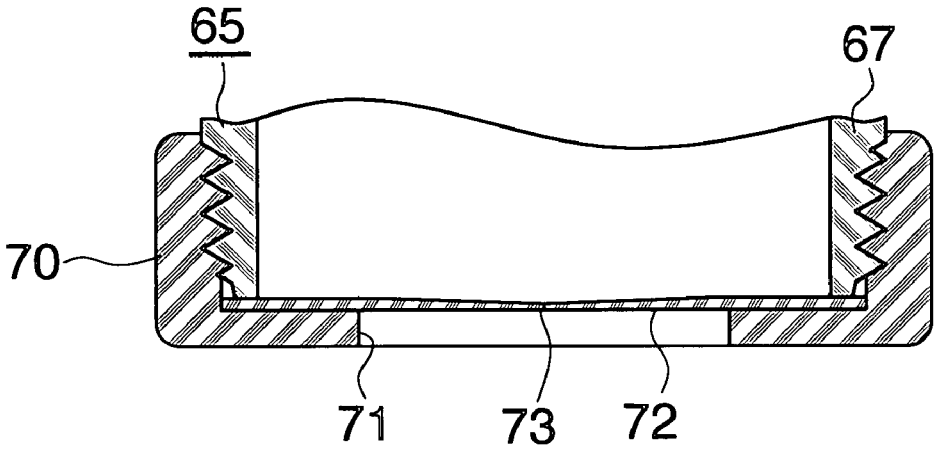
FIG. 9 is a longitudinal cross sectional view showing the bottom portion of the ink container in an enlarged manner.
Figure 10:
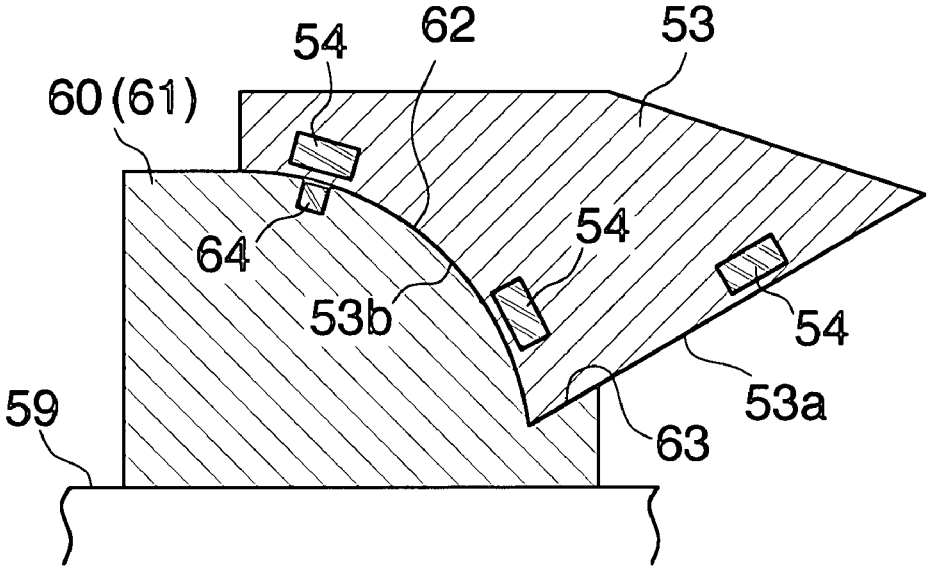
FIG. 10 is an enlarged traverse cross sectional view of a barrier plate rest.

Then, after the ink supply device (86) is moved in front of the desired container holder (77) of the container storage unit (66), the ink supply device (86) moves backward and holds the ink container (65) from the relevant container holder (77). When the ink supply device (86) moves backward towards the container holder (77), the pair of container holding members (93) is opened, the pressing member (99) is raised to the upper end position, and the support member (75) of the container storage unit (66), that is, the container holder (77) is raised to the upper end position, as shown in FIG. 8(*b*). The ink supply device (86) stops at the position where the container (65) is between the pair of container holding members (93), and the container holding members (93) close. FIG. 8(*b*) shows such a state. The container holder (77) lowers to the lower end position from such a state, whereby the container (65) is held by the container holding members (93), as shown in FIG. 8(*a*).

The ink supply device (86) moves forward away from the container holder (77) and moves above the ink fountain (1) when the container (65) is held by the container holding members (93). Subsequently, only the fountain roller (3) is rotated, and the ink is supplied to the ink fountain (1) up to a constant level while reciprocating the ink supply device (86) to the right and to the left with all the vibrating rollers (15) switched to the back end position. In this case, the level of the ink in the ink fountain (1) is made low, so that a small amount of ink retains only at a small portion in the vicinity of the ink channel (52).

After a constant amount of ink is retained in the ink fountain (1), the distributing roller (4) and other rollers are rotated, and the switching of the position of the vibrating roller (15) is controlled to supply the ink to the printing surface and perform printing.

During printing, the ink is supplied to the ink fountain (1) while moving the ink supply device (86) to the right and to the left, whereby the level of the ink in the ink fountain (1) is maintained substantially constant, and a small amount of ink is retained only at a small portion in the vicinity of the ink channel (52). Furthermore, a warning is given when abnormality in switching of the position of the vibrating roller (15) is detected by the output of the change-over detection sensor (102), and the operation is stopped.

When performing the next printing using a different ink after the printing is completed, the replacement procedure is performed in the following manner.

After printing is completed, the ink supply device (86) is first moved in front of the original container holder (77) of the container storage unit (66) and then moved backward to return the ink container (65) to the container holder (77). The ink supply device (86) stops at the position where the container (65) being held is positioned immediately above the bottom receiving part (78) of the original container holder (77). FIG. 8(*a*) shows such a state. In this state, the container holder (77) is stopped at the lower end position. The container holder (77) is raised to the upper end position when the ink supply device (86) is stopped. The container (65) is thus lifted by the bottom receiving part (78) of the container holder (77), as shown in FIG. 8(*b*), and a pair of container holding members (93) opens, and the ink supply device (86) moves forward and moves away from the container holder (77).

Meanwhile, all the vibrating rollers (15) are switched to the back end position to move away from the fountain roller (3), the cleaning tank (56) is switched to the cleaning position to press the blade (57) against the outer peripheral surface of the fountain roller (3), and the fountain roller (3) is rotated in this state. Similar to the time of printing, the ink remaining in the ink fountain (1) is thus applied to the outer peripheral surface of the fountain roller (3) through the ink channel (52), but such ink is scraped off by the blade (57) and collected in the tank (56). After all the ink remaining in the ink fountain (1) is taken out by the fountain roller (3) and collected in the tank (56) by the blade (57), the fountain roller (3) is rotated for a while in such a state. Since the ink remaining on the outer peripheral surface of the fountain roller (3) is mostly scraped off by the blade (57), the tank (56) is thereafter switched to the stand-by position to separate the blade (57) from the fountain roller (3), and the fountain roller (3) is stopped.

After the fountain roller (3) is stopped, the ink fountain member (2) is turned counterclockwise. When the ink fountain member (2) is turned, the fountain member attracting face (53*a*) of the barrier plate (53) is pushed and detached from the fountain-forming face (37*a*) by the ink fountain member (2), whereby the barrier plate (53) rotates counterclockwise together with the fountain roller (3) while being attracted to the fountain roller (3) but immediately contacts the cover (110) and stops. When the ink fountain member (2) is further turned, the barrier plate (53) turns about the abutting portion against the cover (110), and the fountain roller attracting face (53*b*) detaches from the outer peripheral surface of the fountain roller (3). The ink fountain member (2) is stopped with the barrier plate (53) detached from both the ink fountain member (2) and the fountain roller (3) and mounted thereon. When the ink fountain-member (2) is stopped, the barrier-plate holding members (91) of the barrier plate replacing device (85) hold one of the barrier plates (53) and remove it from between the ink fountain member (2) and the fountain roller (3), and transfer the same to the second barrier-plate rest (61), and then similarly remove the other barrier plate (53) and transfer the same to the barrier-plate rest (61).

Figure 11:
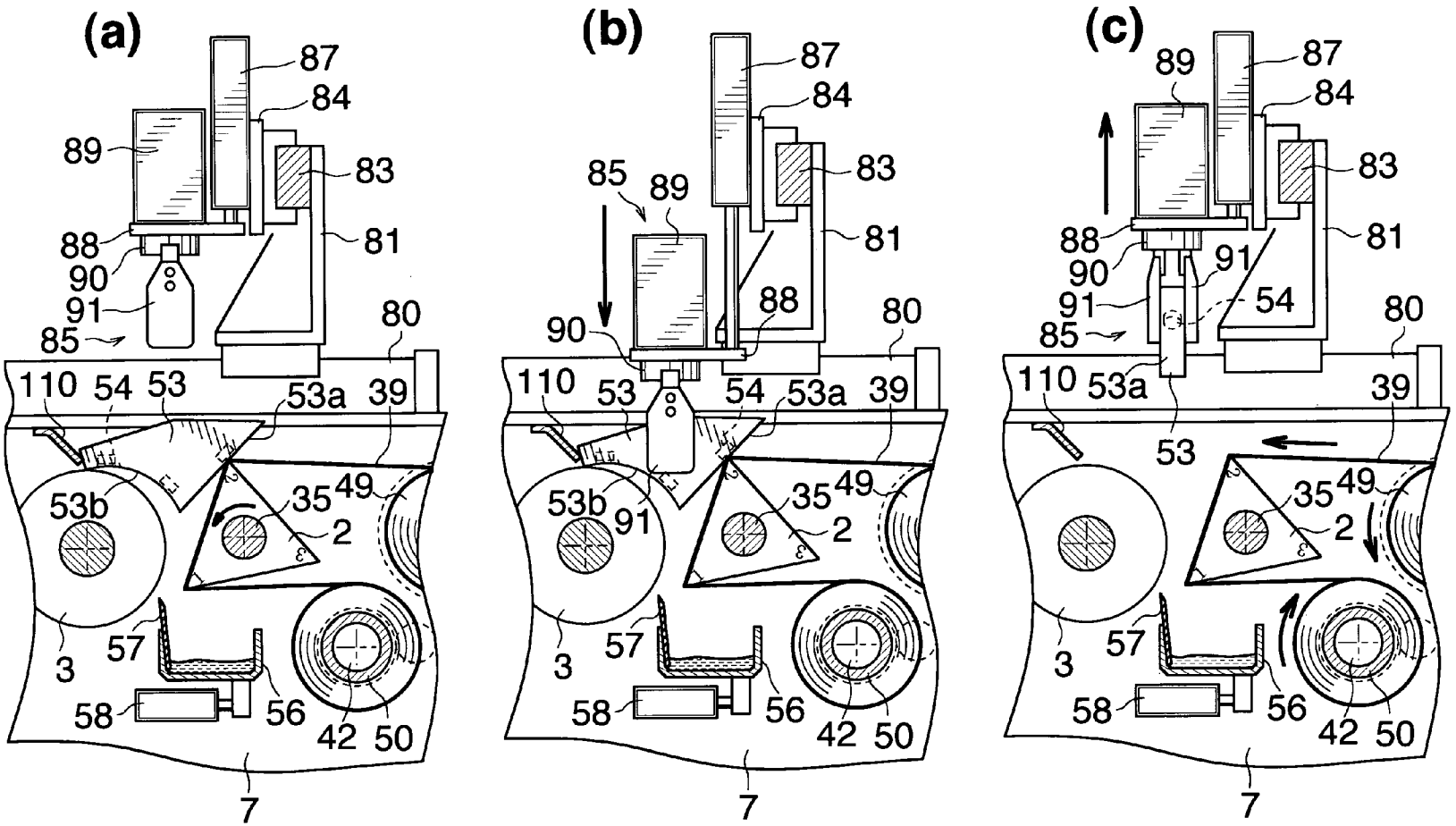
FIG. 11 is a side view showing the operation of a barrier plate replacing device.

The ink transferred to the vibrating roller (15) is transferred to the distributing roller (4) and other rollers by the rotation of the distributing roller (4), and the ink remaining on the outer peripheral surface of such rollers (15), (4) are also reduced. The vibrating roller (15), the distributing roller (4) and other rollers are automatically cleaned as in the prior art. In this case, the cleaning fluid for automatic cleaning can be transferred from the distributing roller (4) side to the fountain roller (3) to automatically clean the outer peripheral surface of the fountain roller (3) by switching the position of the vibrating roller (15) in either of the states as shown in FIG. 11., if necessary.

When the two barrier plates (53) are detached from between the ink fountain member (2) and the fountain roller (3), the sheet (39) of a predetermined length is fed from the sheet roll (49), and wound around the sheet take-up member (50) by the sheet moving device (40). The ink fountain member (2) is then positioned and stopped at the work position for the next printing. The portion of the used sheet (39) in intimate contact with the fountain-forming face (37*a*) during printing and attached with old ink is moved to a position deviated from the fountain-forming face (37), and the portion of the new sheet (39) before use is brought in intimate contact with the fountain-forming face (37).

Subsequently, the next printing is performed similarly to the above.

Figure 12:
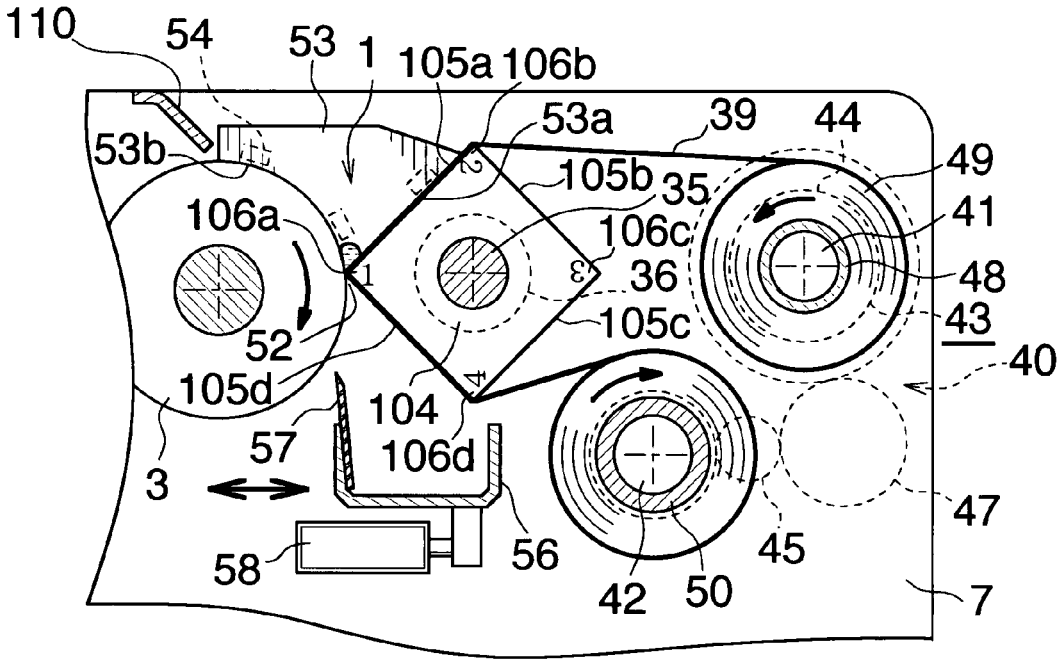
FIG. 12 is a view corresponding to FIG. 5 showing another embodiment of the ink fountain member.

FIG. 12 shows another embodiment of the ink fountain member.

In this case, the ink fountain member (104) has a quadratic prism shape having a cross section of square, and is positioned at four work positions at every 90 degrees and is fixed at each work position. The four side surfaces of the periphery of the ink fountain member (104) serve as fountain-forming faces (105*a*), (105*b*), (105*c*), (105*d*), and the ridge lines at the ends in the counterclockwise direction of each fountain-forming face (105*a*) to (105*d*) serve as the ink channel-defining portions (106*a*), (106*b*), (106*c*), (106*d*) corresponding to the ink forming surface (105*a*) to (105*d*) respectively.

Others are the same as the embodiment as mentioned first, and the same reference characters are denoted for the same components.

Figure 13:
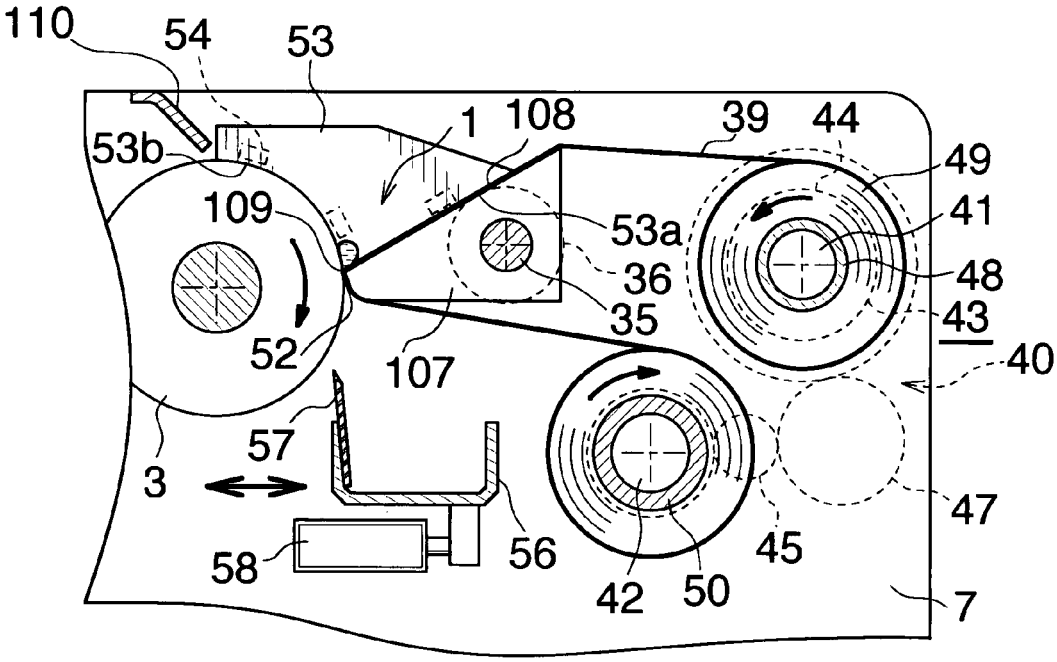
FIG. 13 is a view corresponding to FIG. 5 showing yet another embodiment of the ink fountain member.

FIG. 13 shows yet another embodiment of the ink fountain member.

In this case, the ink fountain member (107) has a triangular prism shape having a cross section of a right triangle, and is positioned and fixed at only one work position. The face extending obliquely rearwardly downward of the ink fountain member (107) serves as the fountain-forming face (108), and the ridge line at the back end (lower end) of the fountain-forming face (108) serves as the ink channel-defining portion (109). In time of replacing the barrier plate (53), the ink fountain member (107) is turned counterclockwise from the work position, and is returned to the work position after the barrier plate (53) is detached in a same manner as mentioned previously.

Others are the same as the above embodiment, and the same reference characters are denoted for the same components.

The entire configuration of the inking arrangement and the configuration of each part of the printing machine are not limited to the above embodiments, and may be appropriately changed.

It should be apparent to those skilled in the art that the present invention may be embodied in many other specific forms without departing from the spirit or scope of the invention. Therefore, the present invention is not to be limited to the details given herein, but may be modified within the scope and equivalence of the appended claims.

Industrial Applicability

The present invention is suited for use in printing machines. Substantial automation of the replacement procedure is achieved, and thus significant simplification of replacement procedure, and reduction of time required for the procedure are achieved by using the printing machine according to the present invention.

The invention claimed is:

1. A printing machine comprising:

an ink fountain member having a fountain-forming face;

an ink fountain roller for applying ink to an outer peripheral surface through an ink channel between the ink fountain roller and the ink fountain member;

a plurality of rollers for supplying the ink applied to the outer peripheral surface of the ink fountain roller to a printing portion;

a strip of sheet placed over the ink fountain member so as to cover the fountain-forming face with the middle portion of the strip of sheet being in intimate contact with the fountain-forming face;

a sheet moving device for moving the strip of sheet in the length direction;

a pair of barrier plates attracted to the fountain-forming face from above the sheet and attracted to the outer peripheral surface of the ink fountain roller by a permanent magnet to form side walls of the ink fountain;

a cleaning tank disposed close to the lower part of the ink fountain roller;

a cleaning blade arranged in the cleaning tank; and a reciprocating device for switching the cleaning blade between a cleaning position being in pressing contact with the outer peripheral surface of the ink fountain roller and a stand-by position being away from the ink fountain roller;

characterized in that the printing machine further comprises:

a barrier plate replacing device for detaching the used barrier plate from the ink fountain member and the ink fountain roller and attaching the new barrier plate to the ink fountain member and the ink fountain roller, the barrier plate replacing device comprising:

a fountain-member turning device for turning the ink fountain member around an axis parallel to the ink fountain roller, and positioning at a predetermined work position, a barrier plate stopper, arranged close to the outer peripheral surface of the ink fountain roller, for stopping the barrier plate rotated with the ink fountain roller away from the fountain-forming face by the turning of the ink fountain member from the work position, and turning the barrier plate in a direction away from the outer peripheral surface of the ink fountain roller, a moving body capable of moving above the ink fountain and being raised and lowered, and a barrier plate holding member disposed in the moving body to hold and release the barrier plate;

a plurality of ink containers, accommodating different types of ink, and being stored in a predetermined container storage unit;

an ink supply device for holding the desired ink container and supplying the ink to the ink fountain, and that a barrier plate attracting portion of a predetermined width having an entire periphery made of magnetic material is arranged at two or more areas in the axial direction on the outer periphery of the ink fountain roller, and a portion other than the barrier plate attracting portion is made of non-magnetic material.

2. The printing machine according to claim 1, wherein the barrier plate stopper is also used as a cover for covering the upper portion of the ink fountain roller.

3. The printing machine according to claim 2, wherein the ink fountain member is turned by the fountain-member turning device to be positioned at one of a plurality of work positions; a plurality of fountain-forming faces in which an ink channel-defining portion at the distal end comes close to the ink fountain roller and forms an ink fountain when positioned at each work position are formed on the periphery of the ink fountain member in the turning direction of the ink fountain member, and the distance from the central axis of rotation of the ink fountain member to each ink channel-defining portion differs from each other.

4. The printing machine according to claim 2, wherein the ink supply device, comprising a level sensor for detecting the level of ink in the ink fountain, detects the level of ink in the ink fountain and supplies the ink to the portion of the ink fountain where the level of ink is lower than a predetermined value during printing operation.

5. The printing machine according to claim 2, wherein the ink container has a bellows shape compressible in the vertical direction, a slit-like aperture that is normally closed is formed at a bottom wall of the container, and the portion of the slit-like aperture is opened by pressure when the upper portion of the ink container is pressed downward while holding the bottom of the ink container so that the ink in the ink container passes through the opened slit-like aperture portion and drops downward.

6. The printing machine according to claim 5, wherein the ink supply device comprises, a moving body that moves above the ink fountain in a direction parallel to the ink fountain roller, container holders disposed on the moving body for holding and releasing the portion including the bottom of the ink container, and a pressing member disposed on the moving body for pushing downward the upper portion of the ink container held by the container holding members.

7. The printing machine according to claim 6, wherein a level sensor for detecting the level of ink in the ink fountain is disposed on the moving body, the moving body moving above the ink fountain in a direction parallel to the ink fountain roller, detecting the level of ink in the ink fountain, and supplying the ink to the portion of the ink fountain where the level of ink is lower than a predetermined value during printing operation.

8. The printing machine according to claim 2, wherein a unit of a plurality of divided vibrating rollers is arranged between the ink fountain roller and an ink distributing roller on an printing portion side, the unit of a plurality of divided vibrating rollers comprising a plurality of vibrating rollers, which are lined in the axial direction of the ink fountain roller and freely rotated individually, and a change-over device for individually switching each vibrating roller between two positions between the ink fountain roller and the ink distributing roller so that the contact state with the two rollers change.

9. The printing machine according to claim 1, wherein the ink supply device, comprising a level sensor for detecting the level of ink in the ink fountain, detects the level of ink in the ink fountain and supplies the ink to the portion of the ink fountain where the level of ink is lower than a predetermined value during printing operation.

10. The printing machine according to claim 1, wherein the ink container has a bellows shape compressible in the vertical direction, a slit-like aperture that is normally closed is formed at a bottom wall of the container, and the portion of the slit-like aperture is opened by pressure when the upper portion of the ink container is pressed downward while holding the bottom of the ink container so that the ink in the ink container passes through the opened slit-like aperture portion and drops downward.

11. The printing machine according to claim 10, wherein the ink supply device comprises, a moving body that moves above the ink fountain in a direction parallel to the ink fountain roller, container holders disposed on the moving body for holding and releasing the portion including the bottom of the ink container, and a pressing member disposed on the moving body for pushing downward the upper portion of the ink container held by the container holding members.

12. The printing machine according to claim 11, wherein a level sensor for detecting the level of ink in the ink fountain is disposed on the moving body, the moving body moving above the ink fountain in a direction parallel to the ink fountain roller, detecting the level of ink in the ink fountain, and supplying the ink to the portion of the ink fountain where the level of ink is lower than a predetermined value during printing operation.

13. The printing machine according to claim 1, wherein a unit of a plurality of divided vibrating rollers is arranged between the ink fountain roller and an ink distributing roller on an printing portion side, the unit of a plurality of divided vibrating rollers comprising a plurality of vibrating rollers, which are lined in the axial direction of the ink fountain roller and freely rotated individually, and a change-over device for individually switching each vibrating roller between two positions between the ink fountain roller and the ink distributing roller so that the contact state with the two rollers change.

14. The printing machine according to claim 13, wherein the unit of a plurality of divided vibrating rollers comprises a support member fixed to a frame so as to be parallel to the ink fountain roller, a plurality of movable members of short circular cylinder shape attached to the support member so as to individually reciprocate in the same direction, a vibrating roller rotatably attached to the outer periphery of each movable member, and a change-over device, arranged on the support member, for individually switching the position of each movable member; and a change-over detection sensor for detecting the switching of the position of the movable member is disposed at the portion of the support member slidably contacting the movable member.

15. The printing machine according to claim 14, wherein the change-over detection sensor is a magnetic sensor, and a permanent magnet is attached to the portion of the movable member facing the change-over detection sensor.

* * * * *